United States Patent [19]

Nitchman et al.

[11] Patent Number: 4,491,247

[45] Date of Patent: Jan. 1, 1985

[54] SYSTEM, APPARATUS, AND METHOD OF DISPENSING A LIQUID FROM A SEMI-BULK DISPOSABLE CONTAINER

[76] Inventors: Harold L. Nitchman, 1230 Parody, St. Charles, Mo. 63301; William B. Cunningham, Jr., 916 Woodshire La., Creve Coeur, Mo. 63141

[21] Appl. No.: 363,511

[22] Filed: Apr. 2, 1982

Related U.S. Application Data

[63] Continuation-in-part of Ser. No. 285,611, Jul. 21, 1981, Pat. No. 4,440,319.

[51] Int. Cl.[3] ..... B67D 5/60; F25J 5/60

[52] U.S. Cl. ..... 222/131; 222/183; 222/396; 220/3; 220/401

[58] Field of Search ..... 222/39, 64, 66, 105, 222/130, 131, 173, 183, 394, 396, 397, 399, 400.7, 541; 220/69, 3, 19, 401, 410; 215/31

[56] References Cited

U.S. PATENT DOCUMENTS

| | | | |
|---|---|---|---|
| 2,294,118 | 8/1942 | Leary | 225/3 |
| 2,400,955 | 5/1946 | Samel | 225/15 |
| 2,673,676 | 3/1954 | Troust | 226/129 |
| 2,756,105 | 7/1956 | Magill | 299/95 |
| 2,766,899 | 10/1956 | Wallace | 215/12 |
| 2,816,691 | 12/1957 | Ward | 222/183 |
| 3,026,005 | 3/1962 | Cook | 222/105 |
| 3,061,129 | 10/1962 | Fitz Gerald | 215/11 |
| 3,117,695 | 1/1964 | Cox | 222/105 |
| 3,165,228 | 1/1965 | Kroesch et al. | 220/69 |
| 3,171,571 | 3/1965 | Daniels | 222/94 |
| 3,191,810 | 6/1965 | Johnston | 222/183 |
| 3,195,779 | 7/1965 | Nicko | 222/82 |
| 3,240,399 | 3/1966 | Frandeen | 222/211 |
| 3,243,084 | 3/1966 | Stegner | 222/95 |
| 3,294,289 | 12/1966 | Bayne et al. | 222/95 |
| 3,349,965 | 10/1967 | Krugger | 222/399 |
| 3,371,822 | 3/1968 | Galloway | 222/95 |
| 3,435,990 | 4/1969 | Pike, Jr. | 222/1 |
| 3,589,506 | 6/1971 | Ford et al. | 206/46 |
| 3,752,362 | 8/1973 | Risener | 222/85 |
| 3,768,706 | 1/1973 | Hill | 222/325 |
| 3,788,511 | 1/1974 | Marsh | 220/9 R |
| 3,876,107 | 4/1975 | Meindl et al. | 222/64 |
| 3,876,115 | 4/1975 | Venus, Jr. et al. | 222/183 |
| 3,945,534 | 3/1976 | Ady | 222/105 |
| 3,948,404 | 4/1976 | Collins et al. | 215/1 C |
| 3,964,636 | 6/1976 | Rehrig | 220/306 |
| 4,045,860 | 9/1977 | Winckler | 29/451 |
| 4,247,018 | 1/1981 | Credle | 222/1 |
| 4,265,374 | 5/1981 | Sebalos | 222/95 |

FOREIGN PATENT DOCUMENTS

| | | |
|---|---|---|
| 1268906 | 3/1972 | United Kingdom . |
| 1446338 | 8/1976 | United Kingdom . |

*Primary Examiner*—H. Grant Skaggs
*Assistant Examiner*—Michael S. Huppert
*Attorney, Agent, or Firm*—Polster, Polster and Lucchesi

[57] ABSTRACT

A system, appartatus, and method of dispensing a liquid (e.g., a beverage, a soft drink concentrate, or other flowable liquid-like material) from a semi-bulk container. The system comprises a liquid impervious container having at least one opening therein. The container is installable within a pressure containment vessel of open construction and a fitting is sealingly secured within the opening. This fitting has a port adapted to be connected to a source of pressurized gas so as to admit gas under pressure into the container and to pressurize the liquid within the container. The fitting further has a dip tube which extends down into the liquid so that liquid may be dispensed from the container via the dip tube under pressure. The pressure containment vessel withstands the internal pressurization forces within the container thus permitting the use of an inexpensive, disposable container.

27 Claims, 32 Drawing Figures

FIG. 18.
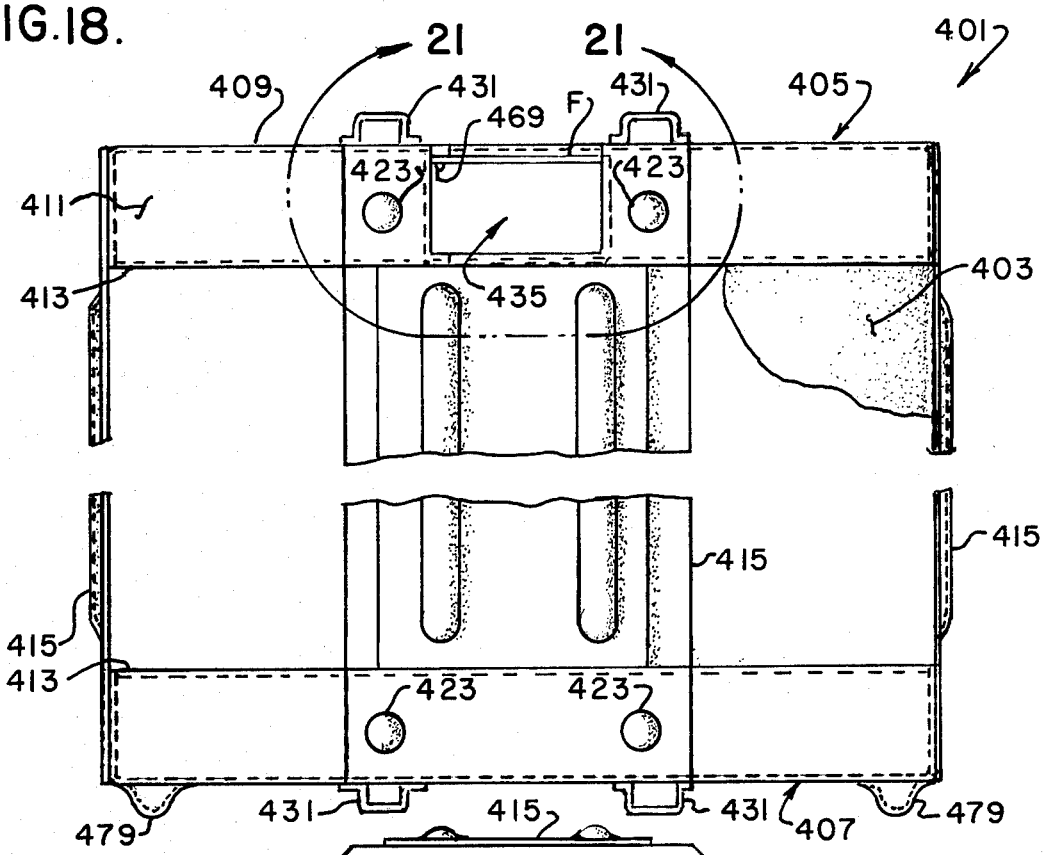
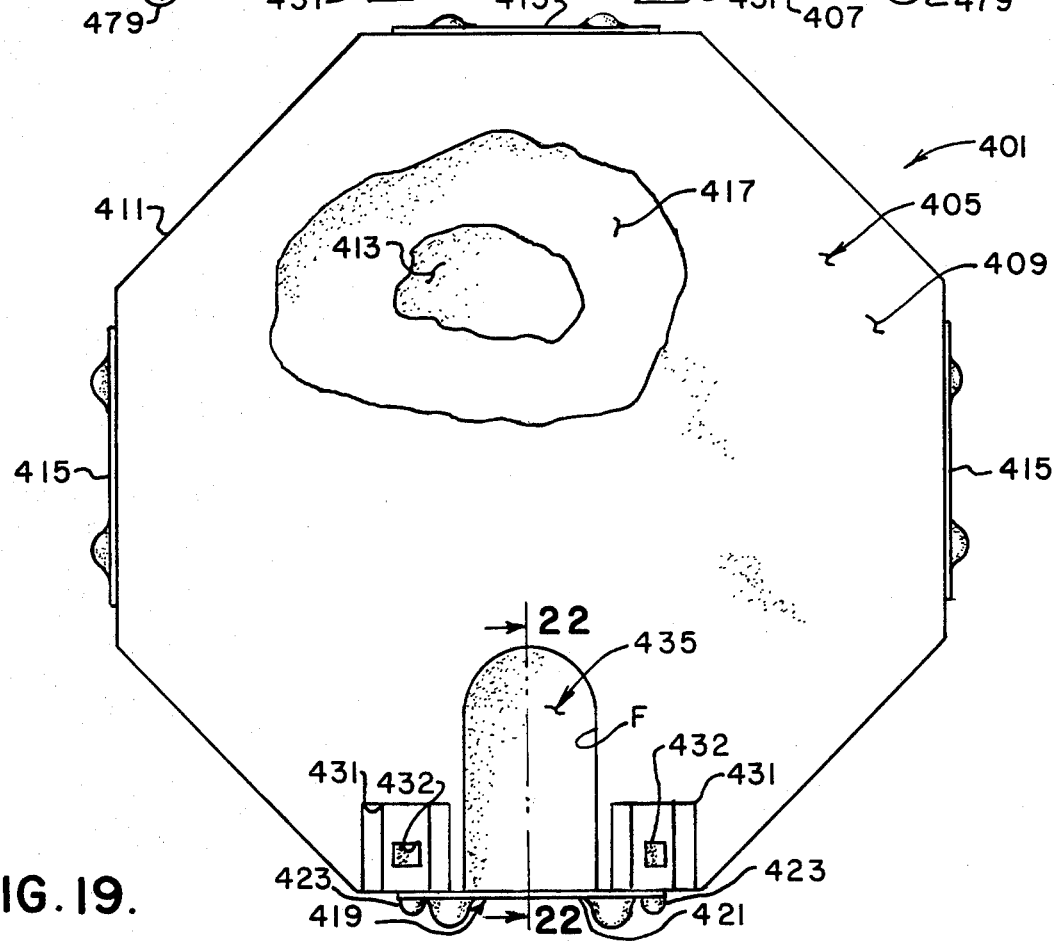
FIG. 19.

FIG. 20.
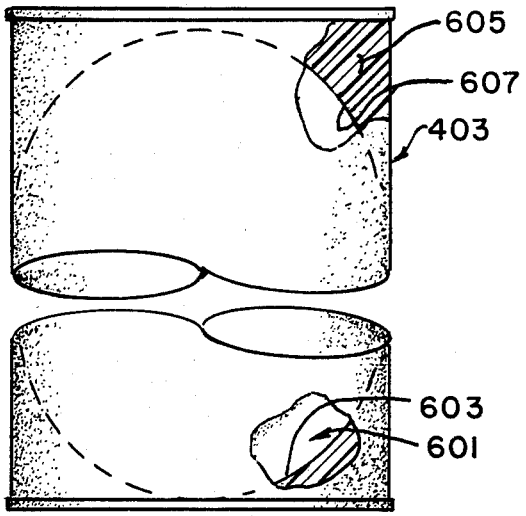
FIG. 21.
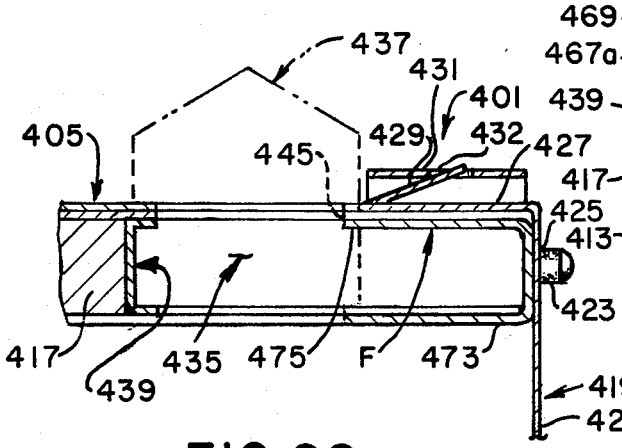
FIG. 22.
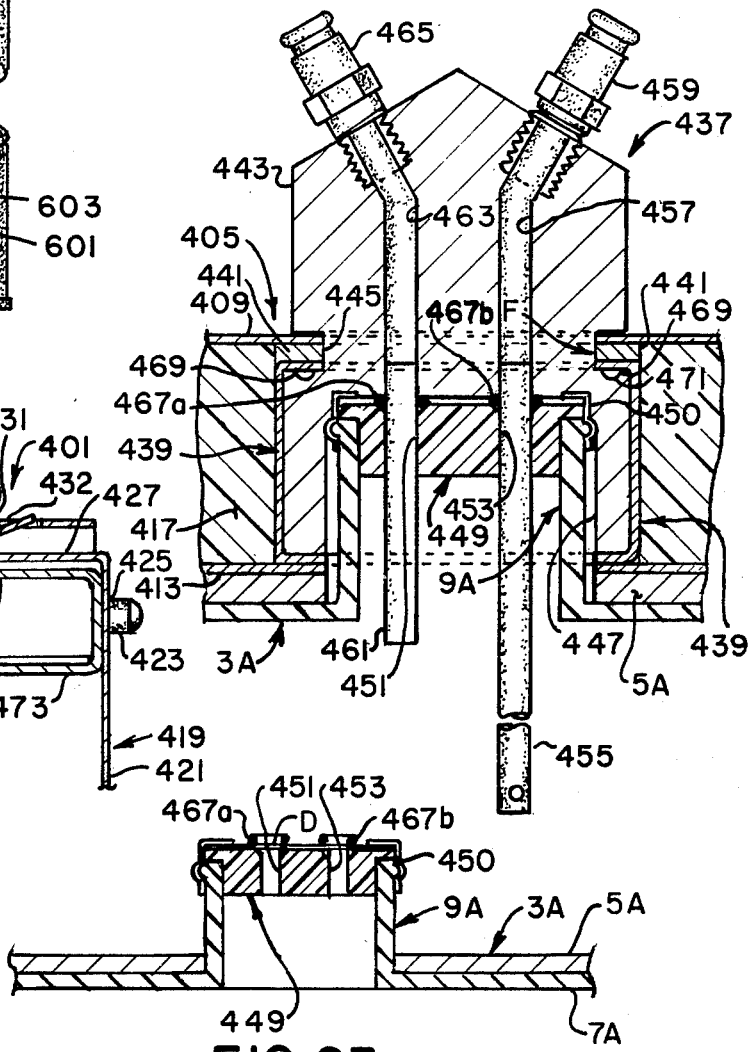
FIG. 23.

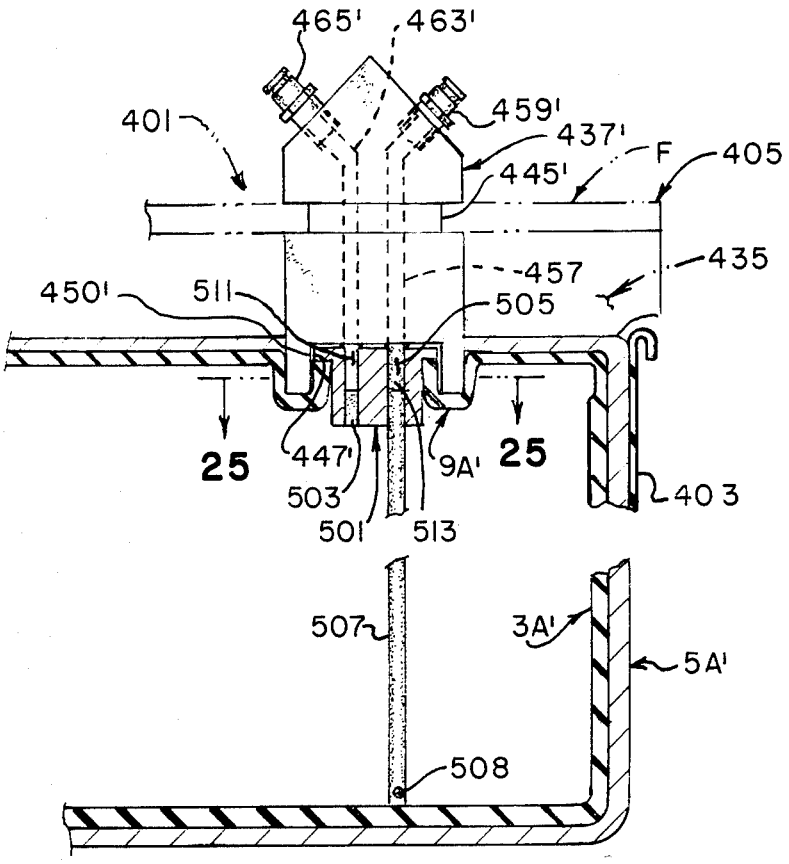
FIG. 24.
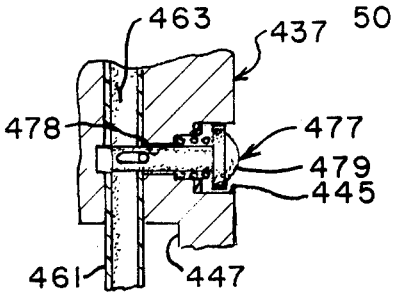
FIG. 27.
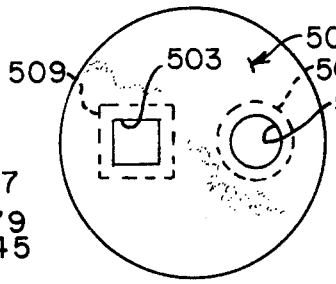
FIG. 25.
FIG. 26.
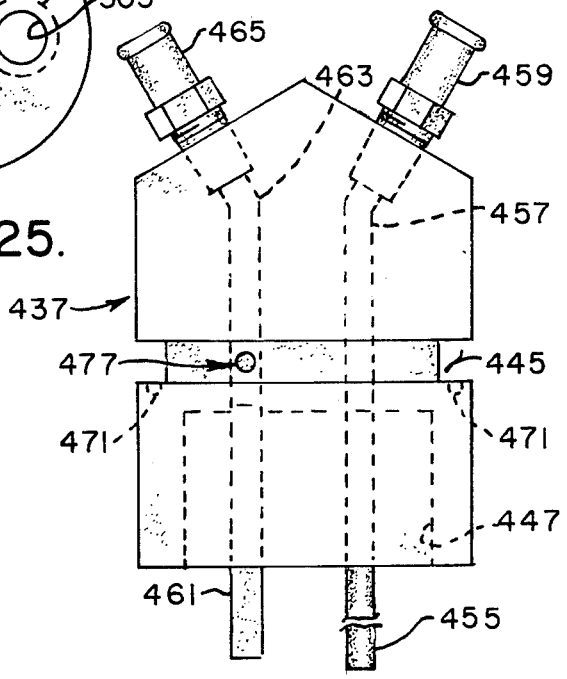

SYSTEM, APPARATUS, AND METHOD OF DISPENSING A LIQUID FROM A SEMI-BULK DISPOSABLE CONTAINER

CROSS-REFERENCE TO A RELATED APPLICATION

This application is a continuation-in-part application of U.S. patent application Ser. No. 285,611, filed July 21, 1981, now U.S. Pat. No. 4,440,319.

BACKGROUND OF THE INVENTION

This invention relates to a system, apparatus, and a method of dispensing a liquid-like material from a semi-bulk container, and is particularly concerned with the dispensing of such a liquid from a disposable or throw-away container.

Heretofore, many liquids, such as wine, soft drink concentrate, and the like, were pressure dispensed from a rigid wall metal container by pressurizing the container with a gas to a pressure level sufficient to force the liquid from the rigid wall container via a dip tube to a dispenser which was located remotely from the container. For example, in a restaurant, a rigid container holding a semi-bulk quantity (e.g., 1-15 gallons) of wine may be located in a refrigerated cold box and piped to a wine dispensing station conveniently located within the restaurant for ready access by restaurant personnel. In dispensing soft drinks mixed with carbonated water and concentrated soft drink syrup, the syrup is conventionally delivered to the restaurant by a soft drink bottler in a rigid, semi-bulk cannister. These cannisters are typically provided with quick disconnect fittings so as to enable a source of pressurized gas (e.g., nitrogen or carbon dioxide) to be connected to the cannister and to pressurize the interior of the rigid cannister and the liquid therein. Typically, the cannister is a reusable container sized to contain approximately 5 gallons of liquid and is constructed so as to withstand a predetermined pressure with an adequate margin of safety.

As was conventional, these prior art cannisters were of sturdy, metal construction, such as stainless steel or the like, and consequently were expensive. On return of these cannisters to the soft drink bottling plant, it was, of course, necessary to clean and sterilize the cannisters prior to reuse. Also, it was often necessary to repair the quick disconnect fittings and other seals on the cannisters so as to prevent leakage. Since these cannisters were reused, it was necessary for the soft drink delivery person to not only deliver filled cannisters to a customer, but the empty cannisters must be collected and reloaded on the delivery truck with consequent increased labor costs.

To overcome problems with manual pouring of beverages (e.g., wine), prior art semi-bulk wine dispensing systems have been proposed. One such system utilizes a stainless steel container into which several gallons of wine from one-gallon jugs may be poured. The container is sealed and is pressurized with nitrogen or carbon dioxide gas (depending on the type of wine to be dispensed) and the pressurized wine is pumped from the container via a dip tube to a convenient dispensing station within the restaurant where the wine may be conveniently dispensed by restaurant personnel. The semi-bulk wine container may be located remote from the serving area in a storage room or in the basement and may be kept in a refrigerated cold box. Additionally, the pressure dispensing of the wine allows automatic and accurate dispensing of predetermined quantities of the wine. More specifically, these prior art semi-bulk wine dispensing systems have utilized electronically controlled, pretimed solenoid valves which when energized will dispense a predetermined volume or quantity of wine. It will be appreciated that if the pressurizing force in the cannister remains substantially constant, and if the dispensing valve remains open for a predetermined period of time, a known quantity of wine will accurately be dispensed. The time required to dispense a desired quantity of wine (for example a liter) will be dependent on the pressure level in the cannister and the length of the hose from the cannister to the dispensing station, as well as other factors. By varying the time that the dispensing valve remains open, predetermined quantities of wine can automatically be dispensed. This is particularly advantageous because it permits a waitress to set a carafe or other container under the dispensing nozzle and to activate the dispenser and then to walk away from the dispenser to attend to other tasks while the container is filled. Since it may take several seconds to fill the container, the waitress need not stand at the container. Additionally, accurate and uniform portions will be served to all customers. No customer is "shortchanged" and the restaurant owner can readily monitor the amount of wine sold. Some prior art dispensing systems include means for keeping track of the wine served thus permitting the restaurant owner to accurately check his cash register receipts against his inventories.

However, the above described dispensing systems may be in conflict with certain state and federal laws and regulations regarding the sale and dispensing of alcholic beverages. Generally, a bar or restaurant owner is required to dispense the alcoholic beverage from the container on which a tax stamp has been affixed. Because the above-described semi-bulk wine dispensing system required the restaurant owner to fill the semi-bulk container with wine from other containers, the wine is not dispensed from the original container on which the tax has been paid.

Because of the nature of the wine market with many major wineries being located, for example, in California, it is not practical to utilize a returnable semi-bulk container as is used in the dispensing of soft drink concentrates. In recent years, a disposable, semi-bulk wine container has been introduced. This container consisted of a leakproof bag of suitable synthetic resin material contained within a corrugated paperboard shipping box. The bag had an inlet/outlet stopper which permitted the bag to be filled. To dispense the wine, the container was installed in a dispenser in the restaurant's serving area and the inlet/outlet was connected to the dispensing nozzle of the dispenser and the container was inverted so that the outlet was at the bottom of the bag. Thus, upon opening the dispensing valve, the wine would gravity flow out of the bag. As the wine flowed out of the bag, atmospheric pressure would collapse the bag. However, because the wine was not pressured dispensed, the advantages of automatic dispensing could not be utilized. Moreover, as the bag within the shipping container collapsed, quantities of wine could be trapped in folds and creases formed in the bag. This, of course, resulted in a waste of some of the wine and thus represented a loss of income to the restaurant owner. Reference may be made to U.S. Pat. No. 3,117,695 which discloses a fluid dispensing system similar to the above-described disposable gravity flow wine dispensing system.

In addition, difficulties have been encountered with dispensing other liquids and liquid-like flowable material such as lubricating grease and soft shortening. Typically, a semi-solid material, such as shortening, is delivered to a bakery in drums and the baker, utilizing a paddle or scoop, must remove a desired quantity of the shortening and weigh it on a scale before adding it to other ingredients. The time required for the baker to scoop out a quantity of the shortening, to weight it, and to close the container represents a significant amount of time in the baking operation. It will be appreciated that oftentimes the baker may make several trips back and forth between the scale and the container of shortening until an exact desired amount of shortening has been measured out.

Reference may be made to the following U.S. patents which indicate generally prior art semi-bulk dispensing apparatus in the same general field as the instant invention: U.S. Pat. Nos. 3,371,822, 3,589,506, 3,768,706, 3,945,534 and 4,045,860.

SUMMARY OF THE INVENTION

Among the several objects and features of the present invention may be noted the provision of a system, apparatus, and method of pressure dispensing a liquid or other flowable material from a disposable, semi-bulk container;

The provision of such a system or method in which a variety of liquids or other flowable fluids may be dispensed from a disposable container under pressure wherein the container is not sufficiently strong to withstand the internal pressurization forces required to pressure dispense the liquid therefrom;

The provision of such a system in which the liquid may be accurately metered as it is dispensed so that predetermined quantities or volumes of the liquid may be readily dispensed;

The provision of such a system which permits the shipping container for the liquid to be used as the pressurization container for the liquid contained therein;

The provision of such a system which prevents the pressurization of the shipping containers without the shipping container being properly installed in a pressure containment vessel or the like which carries the pressure forces exerted internally within the shipping container upon pressurization of the liquid;

The provision of such a system which does not require personnel utilizing this system to undergo any special training or skills to utilize the system;

The provision of such a system in which the capability of the disposable container to withstand pressurization is not dependent upon the strength of the container and thus eliminates the requirement of using only containers which have adequate strength, even when wet, to withstand the internal pressurization forces;

The provision of such a system in which the container may be made in such manner that it may be shipped empty in a collapsed or knocked-down manner and which may be readily erected for filling thereby saving considerable volume in shipping of the empty containers from the container manufacturer to the party filling the container;

The provision of such a system which requires a relatively small capital investment for the party filling the containers or for the end user to utilize the system;

The provision of such a system in which substantially all of the liquid is dispensed from the container;

The provision of such a system in which the closure for the disposable container cannot be removed once the container is pressurized;

The provision of such a system in which the contents of the disposable container remain sanitarily sealed within the disposable container and in which the contents are never exposed to the atmosphere prior to dispensing;

The provision of such a system in which pressurization of the container is prevented unless all parts of the system are properly installed; and The provision of such a system which utilizes a container of relatively simple and inexpensive construction thereby to economically permit the container to be disposed of by the end user after use.

Other objects and features of this invention will be in part apparent and in part pointed out hereinafter.

Briefly stated, the system of this invention relates to the dispensing of a liquid from a semi-bulk container. Specifically, the system comprises a semi-bulk container of liquid impervious construction and having at least one opening therein. Means is provided which is adapted to be sealably secured within this one opening for permitting pressurization of the liquid within the container and for pressure dispensing the liquid from within the container.

The method of this invention involves filling a liquid impervious container with a liquid to be dispensed. The container is inserted into pressure containment means of open construction and the container is fitted with means for internally pressurizing the container. The internal pressurization forces are transferred to the pressure containment vessel and also exert a pressure force on the liquid within the container thereby to force the liquid out of the container via a dip tube.

Other objects and features of this invention will be apparent or will be pointed out hereinafter.

BRIEF DESCRIPTION OF THE DRAWINGS

FIG. 6 is a semi-diagrammatic view illustrating a plurality of semi-bulk containers of the present invention installed within their respective pressure containment vessels and pressurized by a single source of pressurized gas with the respective semi-bulk containers being connected in series so that a large volume of the liquid contained within the individual semi-bulk containers may be dispensed;

FIG. 7 is a view similar to FIG. 6 illustrating a plurality of independent semi-bulk containers of the present invention pressurized by a single pressurization source, but independently dispensing the liquids from within each of the individual containers through a respective dispensing line;

FIG. 8 is an enlarged cross-sectional view taken on line 8—8 of FIG. 3 illustrating a container having a single inlet/outlet neck with a stopper fitting inserted therein having a pressurization port and the dip tube, and further illustrating means carried by the pressure containment vessel for sealably securing the stopper in place within the container neck only when the container is installed within the pressure containment vessel;

FIG. 9 is a top plan view of FIG. 8 taken along line 9—9 of FIG. 8 and further illustrating fastener means for holding parts of the pressure containment vessel in assembled position and for preventing the inadvertent loosening of the stopper securement means thereby to prevent the inadvertent release of pressure from within the container;

FIG. 10 is an exploded diagrammatic view of another embodiment of the system and apparatus of the present invention generally similar to the system illustrated in FIG. 2, except that the container and the pressure containment vessel are of cylindric construction;

FIG. 18 is a front side elevational view of still another embodiment of the pressure containment vessel of the system of this invention;

FIG. 19 is a top plan view of the containment vessel illustrated in FIG. 18;

FIG. 20 is a side elevational view of a shroud adapted to be fitted within the pressure containment apparatus shown in FIG. 18, the shroud being adapted to receive a disposable container containing the liquid to be dispensed;

FIG. 21 is a view of a portion of the pressure containment shown in FIG. 18 with an inlet/outlet closure, pressurization, and dip tube assembly installed on the disposable container and held in place relative to the containment vessel as liquid is dispensed from within the disposable container;

FIG. 22 is a vertical cross-sectional view taken along line 22—22 of FIG. 19 illustrating the closure assembly for the disposable container and further illustrating a removable member fitted onto the containment vessel after the shroud and the disposable container have been inserted within the containment vessel for at least, in part, withstanding tension forces applied to the containment vessel upon internal pressurization of the disposable container;

FIG. 23 is a view similar to FIG. 13 illustrating an alternative embodiment of the inlet outlet of the disposable container;

FIG. 24 is a view of a disposable container of the present invention installed in a containment vessel, such as is illustrated in FIGS. 18–22, with the disposable container having its respective dip tube which is disposable with the container;

FIG. 25 is a cross sectional view taken along line 25—25 of FIG. 24 showing the inlet/outlet fitting for the inner container.

FIG. 26 is a perspective view of an inlet/outlet assembly;

FIG. 27 is an enlarged cross-sectional view of a portion of the inlet/outlet assembly taken along line 27—27 of FIG. 26 showing a normally open valve which prevents pressurization of the disposable container unless the latter is installed in the containment which closes the valve;

Corresponding reference characters indicate corresponding parts throughout the several views of the drawings.

DESCRIPTION OF PREFERRED EMBODIMENTS

Figure 28:
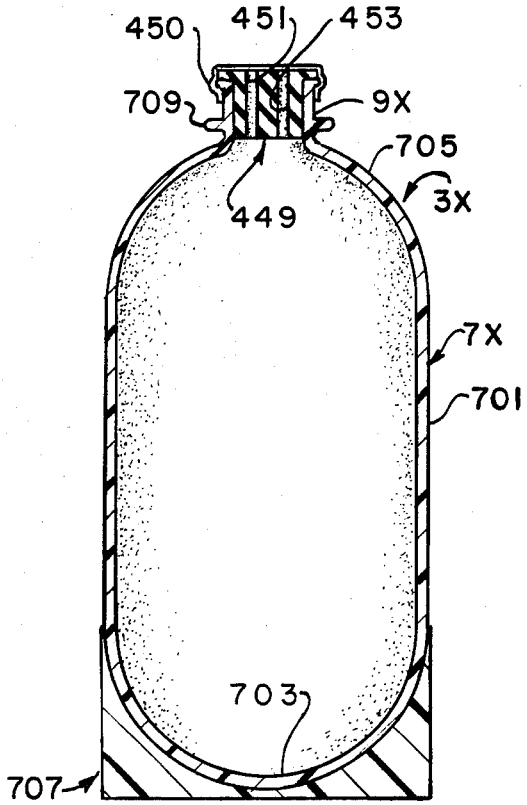
FIG. 28 is a vertical cross-sectional view of another disposable container for use with the system and method of this invention in which the container holds a semi-bulk quantity of liquid and in which the container is, for example, preferably blowmolded of suitable synthetic resin material, having a base cup secured to the part-spherical bottom of the container thereby to enable the container to stand upright with the thickness of the walls of the container shown on an enlarged scale.

Referring now to the drawings, a semi-bulk liquid dispensing system or apparatus of the present invention is shown to be indicated in its entirety by reference character 1. Generally, the liquid pressure dispensing system of this invention comprises a semi-bulk liquid container, as generally indicated at 3 in FIG. 2. The term "semi-bulk" as used herein refers to a volumetric quantity of liquid larger than an individual portion or serving of the liquid to be dispensed from the container, and yet not so large as to preclude the ready handling of the container in its intended application. For example, if the semi-bulk container 3 where intended to contain a beverage, such as wine or soft drink concentrate, the container may be sized so as to contain approximately 5 gallons (18.9 l). This permits the semi-bulk container 3 to be readily manually lifted or carried and installed in the pressure containment means of the system as will be hereinafter described. It will be understood, however, that within the broader aspects of this invention, the volumetric size of semi-bulk container 3 may vary considerably and the above-described 5 gallons (18.9 l) is merely exemplary of one convenient size of semi-bulk container.

Figure 2:
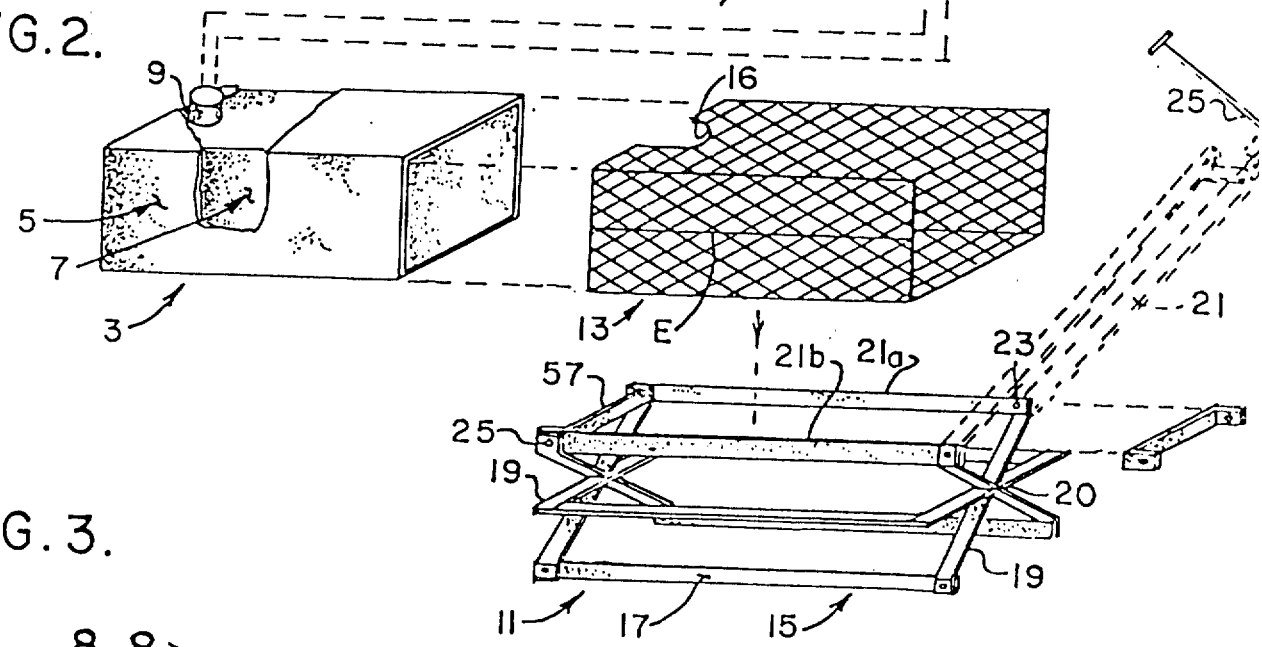
FIG. 2 is an exploded perspective view of the apparatus and system of the present invention illustrating the disposable semi-bulk container, a combination pressurization port/dip tube stopper adapted to be sealably secured within the opening of the container, and the pressure containment vessel.

As is shown in FIG. 2, container 3 comprises an outer container 5 of generally rectangular cross-section formed of a suitable material, (e.g., corrugated box board construction) so as to serve as a shipping container or a protective container. Additionally, an inner, liquid impervious container 7 is contained within outer container 5. This inner liquid container 7 may be made of any suitable material, such as a liquid impervious synthetic resin material. As shown in FIG. 2, inner container 7 is a blow molded container of a suitable plastic resin (e.g., low density polyethylene) having at least one inlet/outlet opening 9 (also referred to as an inlet/outlet fitting) extending therefrom through which liquid may be injected for filling the inner container, through which pressurized compressed gas may be introduced into the interior of the inner container thereby to pressurize the inner container and the liquid therein, and through which pressurized liquid may be discharged from the container. It will be appreciated that inner container 7 may also be made of suitable liquid impervious sheet-material, such as plastic film or the like, formed into a closed bag. Those skilled in the art will appreciate that the inner container 7 may take on any desired configuration and may be made of any one of numerous well-known liquid impervious materials, depending on the application for the inner container and depending on the liquid to be contained within the inner container. For example, in certain applications, the inner container may, instead of being a blow molded bladder or container as described above, consist of a composite synthetic resin/aluminum foil bag lined with a saran resin thereby to provide an oxygen impermeable container for permitting a long storage life of liquids, such as wine or the like, which may undergo deleterious effects upon exposure to oxygen.

Further, the semi-bulk liquid pressurized dispensing system 1 of this invention is shown to comprise a pressure withstanding containment means, as generally indicated at 11, which receives semi-bulk liquid container 3 and which withstands the majority of the pressurization loads exerted on container 3 upon pressurization of the liquid therein. In accordance with this invention, the pressure containment means 11 is shown to be of open construction so as to prevent the pressure containment means from having gas pressure sealably contained therewithin thus making the containment means a pressurized container. More specifically, containment means 11 is shown to comprise a shroud 13 of open construction, and more particularly a shroud formed of open mesh, metal construction adapted to readily, but yet snuggly, receive semi-bulk liquid container 3. It will be understood, however, that the construction of shroud 13 of mesh is merely illustrative. In some instances, construction of shroud 13 of smooth sheet metal may be preferred to aid in sliding container 3 in and out of the shroud. With the semi-bulk container 3 received within shroud 13, the shroud together with the container may be readily inserted in a rigid frame 15 for further supporting shroud 13 and the ends of container 3 whereby shroud 13 together with frame 15 effectively withstands internal pressurization forces exerted on container 3 upon internal pressurization thereof and whereby these pressurization forces are effectively transferred through the container to shroud 13 and to frame 15. It will be appreciated that, in accordance with this invention, neither inner container 7 nor outer container 5 of semi-bulk container 3 need to have sufficient structural integrity to withstand any substantial pressurization forces, but rather the pressurization forces exerted on the container are transmitted to the pressure containment means 11 thus permitting container 3 to be of relatively low strength and yet permitting the system of this invention to be capable of withstanding the internal pressurization forces. It will further be understood that pressure containment means 11 including shroud 13 and frame 15 are designed with a sufficient margin of safety to withstand the normal internal pressurization forces to be exerted within container 3 substantially without structural damage or deformation to either shroud 13 or to frame 15.

As mentioned above, shroud 13 is a generally open ended rectangular shroud of open wire mesh construction with the abutting ends, as indicated at E in FIG. 2, of the wire screening forming the shroud being positively secured (e.g., welded together) such that shroud 13 is effective in withstanding hoop stresses exerted on the shroud upon the internal pressurization of container 3. Further, shroud 13 is provided with a blind-notch, as indicated at 16, in one end thereof, for receiving inlet/-outlet fitting 9 of inner container 7 as container 3 is inserted endwise into shroud 13.

Frame 15 is shown to have a plurality of side bars 17 extending along the bottom and sides of the frame and end members 19 secured to the side bars and intersecting one another at the end faces of container 3 when the latter is installed in the frame so as to form a spider frame 20 (also referred to as a frame end) at each end of container 3. A pair of movable top frame members, 21*a*, 21*b*, are pivotally connected, as indicated at 23, at one end to the end frame members 19 at one end of frame 15 and are swingable between an open position (as shown in phantom lines in FIG. 2) in which shroud 13 together with container 3 received therein may be dropped downwardly into the open frame and a closed position (as shown in solid lines in FIG. 2) in which the movable top frame members are engageable with the top of shroud 13 and in which the free ends of the movable top members are positively secured to the end frame member 20 at the end of the frame opposite from the pivotal connections 23 by means of a removable fastener 25 thereby to lock the top frame members in their closed position and to transfer pressure forces from container 3 to frame 15 via the upper wall of shroud 13.

Figure 3:
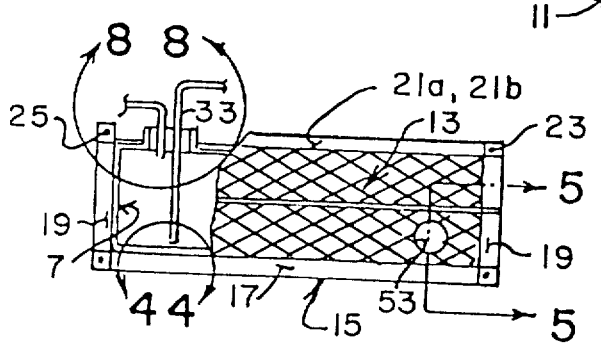
FIG. 3 is a side elevational view of the system of this invention with the disposable container installed within the pressure containment vessel and with portions of the latter broken away so as to illustrate the construction of the inlet/outlet fitting incorporating the pressurization port and the liquid dispensing dip tube.
Figure 4:
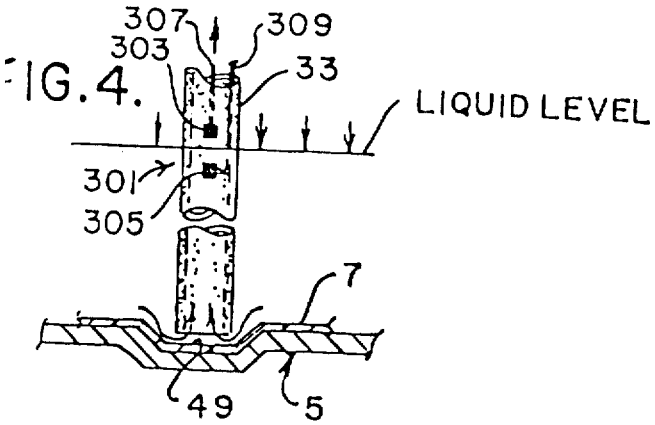
FIG. 4 is a view taken on line 4—4 of FIG. 3 in an enlarged scale illustrating the relation of the bottom end of the dip tube to the bottom of the container wherein a recess is formed in the container so as to insure that substantially all of the liquid within the container may be pressure dispensed from the container.

Further in accordance with this invention, system 1 includes a combination inlet/outlet stopper, as generally at 27, for being sealably fitted within the opening inlet/-outlet fitting 9 of inner container 7 for sealably closing the fitting. The stopper includes a body 29 received within the opening of fitting 9 and having a pressurization tube 31 and a liquid dispensing dip tube 33 sealingly secured thereto. It will be understood that with stopper 27 installed in the opening of fitting 9, pressurization tube 31 is in communication with the interior of inner container 7 and the portion of dip tube 33 extending down from stopper body 29 is of such a length as to be positioned proximate the bottom of inner container 7, as shown in FIGS. 3 and 4. Pressurization tube 31 and dip tube 33 are preferably each provided with a respective quick disconnect fitting 35 for purposes as will appear.

Referring now to FIGS. 8 and 9, system 1 is preferably provided with means, as generally indicated at 37, for sealably securing stopper 27 within fitting 9 with this securement means being carried by movable top frame members 21*a*, 21*b* and with the sealing securement means being only engageable with fitting 9 and with stopper 27 when container 3 is installed within pressure containment shroud 13 and when the latter is installed in frame 15 with the latter closed. This, in turn, prevents the container 3 being pressurized without it being installed in the pressure containment means 11.

Figure 1:
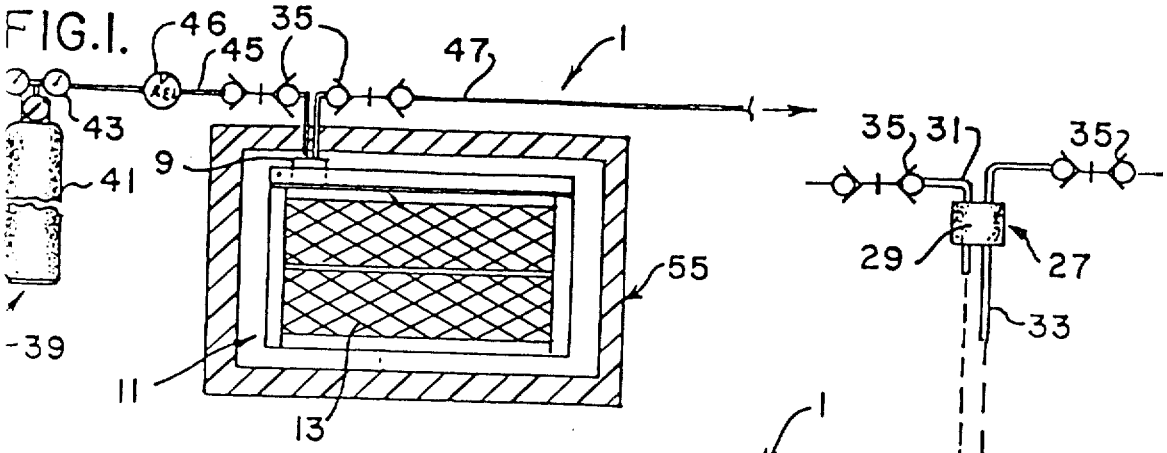
FIG. 1 is a semi-diagrammatic view of the apparatus or system of the present invention for dispensing a liquid from a semi-bulk, disposable container illustrating the semi-bulk container installed within a pressure containment vessel and further illustrating a source of compressed gas connected to the container for internally pressurizing the container and also illustrating a discharge tube for the pressurized dispensing of the liquid to a dispensing station (not shown) remote from the container, the containment vessel being illustrated within a refrigerated compartment.

Further, system 1 of this invention comprises a source of pressurized gas, as generally indicated at 39, for the internal pressurization of inner container 7 by means of pressurization tube 31 on stopper body 29. As shown in FIG. 1, gas pressurization source 39 includes a bottle or other container 41 of compressed gas (e.g., carbon dioxide or nitrogen) under high pressure (e.g., 2,000 psig). A pressure regulator 43 regulates the high pressure within bottle 41 down to a predetermined pressure level which may, for example, be preset to any desired lower pressure level. For example, in dispensing a liquid such as wine from within container 3, regulator 43 may be set to regulate the pressure applied to the interior of inner container 7 to approximately 10 psig, depending on the distance the semi-bulk liquid pressurization dispensing system 1 of the present invention is located from the desired point of dispensing and other factors, such as the flow resistance of the dispensing apparatus (not shown) and the flow restriction characteristics of the piping or tubing leading from the semi-bulk container 3 to the dispensing station. In other applications, such as in the dispensing of soft drink concentrate from within container 3, a higher internal pressurization force (e.g., 45 psig) may be required so as to insure that the soda concentrate dispensed from within container 3 may be forcefully injected into carbonated water in a soft drink post-mixing apparatus of a type well-known to those skilled in the art. It will be appreciated that, depending on the desired pressures to be utilized in a particular application, the design and strength requirements of containment means 11 may be varied according to the desired pressurization level and the desired safety factor.

Pressure regulator 43 is shown to be connected to the quick disconnect fitting 35 on pressurization tube 31 by means of a pressurization line or hose 45. A pressure relief valve 46 is incorporated in the pressurization line 45. Typically, pressure relief valve 46 will be preset to relieve pressure from pressurization line 45 and from within inner container 7 at a preset pressure level somewhat above the predetermined pressurization level as determined by the setting of pressure regulator 43, but below the ultimate pressure level of container 3 within containment means 11. Additionally, pressure relief valve 46 may be provided with a selectively operable bleed valve (not shown) so as to permit the release of pressure from within container 3 upon termination of the flow of pressurization gas from bottle 41 when it is desired to relieve internal pressurization of container 3 and to remove fitting 27 from inlet/outlet fitting 9.

A dispensing line 47 is removably, sealingly connected to dip tube 33 by means of its respective quick-disconnect fitting 35 thereby to permit the container 3 to be readily connected to and to be disconnected from the dispensing line which may run a considerable distance from the location of the semi-bulk liquid dispensing system of the present invention to a dispensing head (not shown). It will be understood that by providing quick-disconnect fittings 35 for pressurization line 46 and dispensing line 47, these lines may be quickly installed on or removed from stopper 27 substantially without leakage of liquid or gas pressure. Further, it will be understood that an accumulator (not shown) may be incorporated in pressurization line 45 to accommodate pressure surges upon dispensing liquid from container 3.

As shown in FIG. 3, dip tube 33 extends down into inner container 7 and the open lower end of the dip tube is disposed proximate the bottom surface of the inner container. It will be understood that when stopper 27 is installed in fitting 9, the bottom of dip tube 33 is positioned in close proximity (almost touching) the inside face of container 7 opposite fitting 9. When the container is pressurized, the container will expand somewhat thus providing a space between the bottom of the dip tube and the container thereby permitting substantially all of the liquid to be pressure dispensed. Also, container 3 may be inclined so that the liquid flows toward fitting 9.

Further, as shown in FIG. 4, a depression or well 49 may optionally be provided in the bottom of container 7 and dip tube 33 may be of a predetermined length so that when stopper body 29 is sealably fitted within inlet/outlet fitting 9, the bottom of the dip tube extends down into the well, but yet is spaced somewhat above the bottom of the well thereby permitting pressurized liquid within the tank to flow upwardly into the dip tube and thereby to insure that substantially all of the liquid contained within container 3 is pressure dispensed from within the container leaving very little liquid which is not capable of being pressure dispensed.

Figure 5:
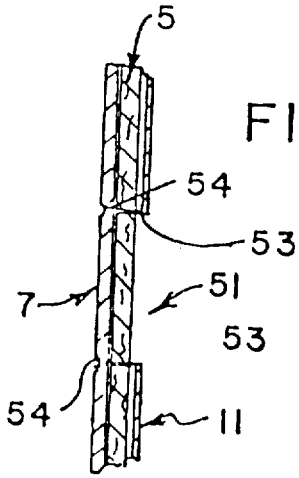
FIG. 5 is a view taken on line 5—5 of FIG. 3 illustrating an enlarged scale an area of weakness performed in the container wherein, upon pressure forces exceeding a predetermined pressure level, the container will rupture in the area of weakness provided in the container and in the corresponding opening in the containment means thereby to relieve pressure from within the container at a predetermined level.

Referring now to FIGS. 3 and 5, means 51 for preventing over-pressurization of container 3 is provided in the system of this invention. More specifically, this over-pressurization preventing means is shown to comprise an unsupported opening 53 in shroud 13. Specifically, this opening 53 in shroud 13 is so sized that a predetermined area of outer container 5 and of inner container 7 is not supported by pressure containment means 11 such that when the internal pressurization forces within container 7 exceed a predetermined value, local bursting of container 3 will result in the area of opening 53 thereby releasing pressure from within the container at a desired location and in a desired direction so as to minimize damage to pressure containment means 11 and to prevent injury to surrounding property or personnel. It will be understood by those skilled in the art, that the portion of container 3 adapted to be in register with opening 53 may be constructed to have predetermined lines of weakness 54 therein so that the portion of container 3 in register with opening 53 constitutes a blowout disk or safety relieve disk.

Referring again to FIG. 1, it will be understood that, in accordance with the system and method of this invention, the semi-bulk container 3 together with its pressure containment means 11 may be installed in a refrigerated compartment 55 at some distance remote from the desired dispensing station (not shown). Thus, semi-bulk beverage containers 3 in their respective pressure containment means 11 may be located in a cold room in an area remote from the serving location for the beverage. In a restaurant, containers 3 containing bulk wine may be located in a back storage room or even in the basement of the restaurant. Likewise, in fast food restaurants, containers 3 containing supplies of soft drink concentrate, may be located in the basement or in an adjoining storage room thereby to leave the serving area of the restaurant free of large numbers of soft drink containers and eliminating the necessity of interfering with the food serving activities of the restaurant personnel upon changing of the soft drink concentrate containers.

Again referring to FIGS. 8 and 9, means 37 for sealably securing stopper 27 in place within inlet/outlet fitting 9 of inner container 3 will now be more particularly described. As indicated at 57, a crossbar is secured to and extends between the top frame members 21*a*, 21*b* of frame 15. A bracket 59 is rigidly secured (welded) to the inner face of crossbar 57 and this bracket 59 is provided with a U-shaped opening 61 therein adapted to mate with and to engage at least a portion of fitting 9 when the movable frame support bars 21*a*, 21*b* are in their lowered position and when locking pin 25 securely fastens the outer ends of the movable frame arms 21*a*, 21*b* to the end frame members 19 when the top frame members are in their lowered, secured positions. Preferably, fitting 9 is provided with a circumferential groove G (see FIG. 8) therearound defined by a pair of spaced shoulders and bracket 59 is provided with a flange F which is received in groove G thereby to restrain axial (i.e., in and out) movement of fitting 9 relative to inner container 7 and to bracket 59. A flexible strap 63 is secured at one end to bracket 59 with this strap extending around the side of fitting 9 opposite that received in U-shaped opening 61 of bracket 59 and the outer end of strap 63 terminates in a threaded stud 64 which protrudes outwardly from an apperture (not shown) in crossbar 57. A wing nut 65 or other threaded fastener threadably engages the portion of stud 64 extending out through crossbar 57. Upon tightening wing nut 65, strap 63 is drawn into firm engagement with fitting 69 and the fitting is in turn circumferentially compressed between the strap and the portions of bracket 59 defining opening 61 and flange F thereby to sealably engage stopper body 29 inserted within the opening of fitting 9. In this manner, upon tightening wing nut 65 and compressing fitting 9, the stopper body 29 is positively and sealably held within fitting 9. As explained above, flange F cooperates with groove G to restrain axial movement of fitting 9.

Additionally, flange 59 has a lower plate 66 engageable with the portion of inner container 7 adjacent fitting 9 thereby to support the inner container proximate fitting 9 and to enable the container to better withstand internal pressurization forces. It will be understood that plate 66 thus constitutes means carried by the movable portion of frame 15 engageable with the container 7 proximate the fitting 9 for locally supporting the container.

As is best shown in FIGS. 8 and 9, with wing nut 65 tightened so as to sealably secure fitting body 29 within fitting 9 and with lock pin 25 inserted so as to positively secure frame members 21*a*, 21*b* in their lowered locked position relative to end frame members 19, lock bar 25 is positioned relative to wing nut 65 so as to effectively prevent turning of the wing nut any appreciable degree thereby preventing loosening of means 37 sealably securing the stopper body within fitting 9. This, in turn, effectively prevents the release of the stopper from within fitting 9 while container 3 is pressurized since it is difficult to remove the lock bar from the frame members while the frame members 21*a*, 21*b* are transferring any appreciable pressure load from container 3 to the end frame members 19. Before pin 25 can be withdrawn, gas pressure within container 7 must be released via the bleed valve incorporated in relief valve 46. For example, this bleed valve may constitute the spring-loaded relief valve having a finger pull ring manually actuable to release pressure from within container 7.

It will be appreciated by those skilled in the art that other arrangements for sealably securing stopper 27 to fitting 9 may be employed. For example, stopper 27 may be formed in the shape of a screw cap which threadably engages screw threads formed either on the exterior or the interior of fitting 9. Further, within the broader aspects of this invention, while container 3 has been shown to have a single inlet/outlet fitting 9 with the pressurization line 31 and with the liquid dispensing dip tube 33 being contained within a single stopper 27, container 7 may be provided with separate openings, one for pressurization of the liquid and one for the dispensing of the liquid. In certain applications, such as in the dispensing of paste-like, semi-liquid materials (e.g., lubricating grease or the like), it may be desirable to have the pressurization opening for container 3 at the top and for having the dispensing outlet opening at the bottom of the container. As used in the specification and claims of this application, the term "at least one inlet/-outlet opening" shall include both a single opening, as shown in the drawing figures, and also the provision of such containers which have multiple openings in the container with at least one of the fittings being provided for pressurization of the contents of the container and with another of the openings being provided for dispensing of the contents of the container.

Referring again to container 3 shown in FIG. 2, inner container 7 was defined to be a liquid impervious, bladder-type container capable of holding a predetermined volume of liquid and capable of being sealed so as to permit the internal pressurization of the container with consequent pressurization of the liquid therein. As noted above, inner container 7 may be of a pliant synthetic resin material (e.g, a blow molded plastic bottle or a plastic film bag) while the outer container was defined as being a corrugated fiberboard box. It will be appreciated that the main purpose of inner container 7 is for the sealable containment of the liquid and for the leak-tight pressurization of the liquid contained therein. The primary function of outer container 5 is that of a shipping container providing adequate strength support and protect the inner container against damage (e.g., puncture) during shipping and storage of container 3.

It will be further understood that, in accordance with the broader aspects of this invention, outer container 5 need not contribute substantially to the capability of container 3 to withstand internal pressurization forces. Instead, pressure containment means 11 engageable with the sides and ends of container 3 is intended to effectively have the pressure loading of the system transferred thereto and to withstand all (or substantially all) of the pressure forces. Thus, even though outer container 5 may be made of a relatively inexpensive material, such as corrugated fiberboard, the container may be utilized even in the event the outer container gets wet and looses a substantial portion of its strength. This permits the use of a relatively weak, inexpensive container for use in pressure dispensing of the contents of the container and enables the end user to economically dispose of the container after use.

Now referring to FIG. 6, a number of pressure dispensing units, of the present invention, as generally indicated at 1*a*, 1*b* and 1*c*, are shown connected in series to one another and each being internally pressurized by means of a single gas pressurization source 39 whereby the contents of all of the containers 3*a*, 3*b*, and 3*c* may be dispensed via a single dispensing line 47*c*. In this manner, a relatively large volume of liquid may be dispensed without the necessity of having to relieve pressure from the system and to replace empty containers. It will be understood that as gas pressure flows from bottle 41 via line 45 into the first container 3*a*, this first container becomes internally pressurized and that the liquid forced out of the first container via its dip tube 33*a* and dispensing line 47*a* becomes the pressurization force exerted on the next container 3*b*. Likewise, the liquid dispensed from the second container 3*b* via its dip tube 33*b* and dispensing line 47*b* serves to pressurize the liquid within the third container 3*c*. This in series connection of containers 3*a*, 3*b*, and 3*c* each containing the same type of liquid is particularly advantageous in busy restaurant applications (e.g., fast food restaurants) because at the beginning of the day, an adequate supply of liquid (e.g., soft drink concentrate) can be hooked up to the remote dispensing units thereby preventing (or reducing) the possibility of the restaurant from inadvertently running out of the liquid being dispensed, particularly at critical busy periods.

In FIG. 7, an alternative arrangement for the connection of a number of semi-bulk liquid pressurized dispensing systems of this invention is illustrated in which systems 1*x*, 1*y*, and 1*z* including respective containers 3*x*, 3*y*, 3*z* are shown connected in parallel to a single pressurization source 39 and in which a single pressurization line 45 is connected to pressurization ports 31*x*, 31*y* and 31*z* leading into each of the containers thereby to pressurize the liquid contents of each of the containers. The dip tubes 33*x*, 33*y* and 33*z* of each of the containers is each connected to a respective liquid discharge tube 47*x*, 47*y*, or 47*z* whereby the liquid for each of the containers 3*x*, 3*y* or 3*z* may be dispensed via its respective dispensing line. In this manner, multiple kinds of liquid (e.g., different kinds of wine or soft drink concentrate) may be selectively dispensed from their respective containers and yet only a single pressurization source 39 is required.

Referring now to FIG. 10, another embodiment of the pressurization system of this invention is indicated in its entirety by reference character 1'. In this embodiment, primed reference characters indicated corresponding parts having a similar construction and function to the corresponding parts described above in regard to the embodiment shown in FIGS. 1–9. Specifically, this second embodiment utilizes a cylindric container 3' having a cylindrical outer container 5' and an inner cylindrical container 7'. For example, outer container 5' may be a fiber drum of wrapped paper construction having an integral bottom 69. An over fitting cover or cap 71 is adapted to be telescopically fitted on the open end of outer container 5' after the inner container 7' has been inserted in outer container 5'. As shown in FIG. 10, inner container 7' has an inlet/outlet filler neck 9' extending out the side of the inner container and it will be appreciated that outer container 5' may have a blind-notch (not shown) adjacent the open mouth thereof to receive filler neck 9'. It will further be understood that this blind notch permits the filler neck to be positioned from the open mouth of the outer container 5' a distance sufficient so as to permit over fitting lid 71 to fit snuggly down on the outside of the open end of the outer container. Further, it will be understood that over fitting cap 71 may also have a blind notch (not shown) therein adapted to receive fitting 9' when the latter is extended. Cap 71 may be secured in place on outer container 5' by means of a suitable adhesive applied to the inner surface of the over fitting cap or by a piece of tape (not shown) wrapped around the portion of the over fitting cap and an adjoining portion of the outer surface of the outer container. In this manner, tension loads applied on the cap upon internal pressurization of the inner container will be transferred to the outer container 5'.

Further, cylindric pressure containment shroud 11' is shown to have a blind notch 16' in one end thereof for reception of the filler neck 9' in the same manner as described above in regard to the embodiment shown in FIG. 2. Frame 15' is substantially identical in construction and operation to frame 15 described above in regard to FIG. 2. However, frame 15' is shown to include an optional end plate 72 secured to the inner face of each of the end frame members 19' to engage the outer ends 69 of outer container 5' and the outer end face (not shown) of the over fitting lid 71 thereby to more effectively transmit the internal pressurization forces exerted on the ends of container 3' to frame end 19'. It will be understood that these end plates 72 may be also used on frame 15 illustrated in FIG. 2 and may be preferred.

Figure 12:
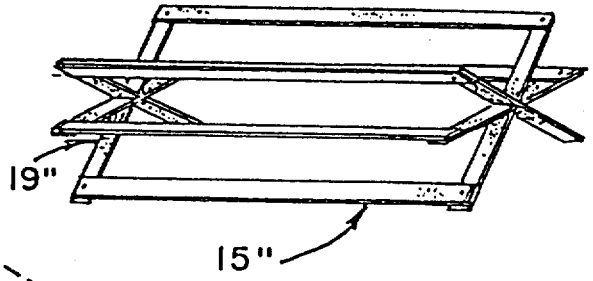
FIG. 12 is an exploded perspective view of still another embodiment of the system of the present invention consisting of a liquid impervious inner container having a collapsible spout extending from one end thereof into which the inlet/outlet stopper is adapted to be fitted and with the inner container adapted to be received in a disposable, outer container of sufficent strength to withstand the internal pressurization forces whereby the outer container comprises the pressure containment means.
Figure 12:
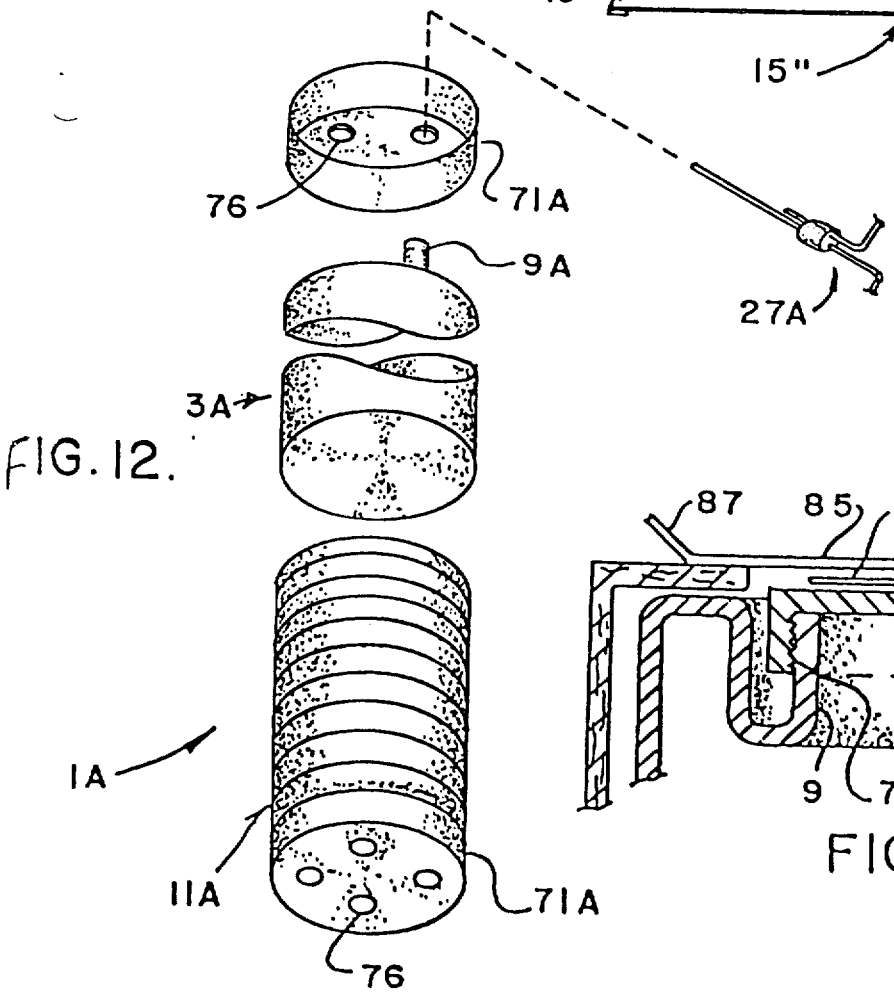

Referring now to FIG. 12, another variation of the system of the present invention is illustrated and is identified by reference character 1''. This other embodiment comprises a cylindric outer container 5'' and over fitting lid 71'' similar in construction to outer container and lid shown in FIG. 10. Inner container 7'' is shown to be blow molded plastic bladder or bottle adapted to fit within outer container 5''. However, the inner container has an inlet/outlet filler neck 9'' extending endwise therefrom and adapted to fit through an opening (not shown) in the end face of lid 71 so that the filler neck extends through the lid when the lid is installed in place. It will be appeciated by those skilled in the art that fitting 9'' is adapted to fit readily between end frame members 20'' of end frame 19''. Similarly, a combination inlet/outlet stopper 27'' may be sealingly fitted in filler neck 9'' in a manner similar to that described above in regard to the other containers 3 and 3' heretofore described.

Figure 11:
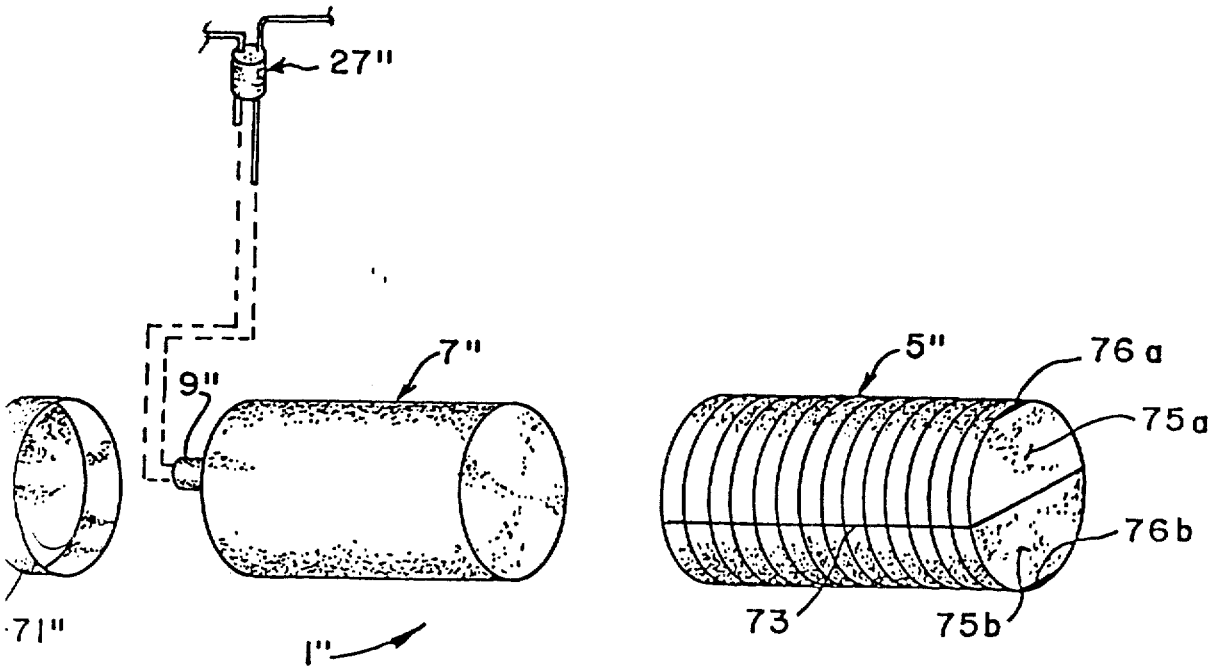
FIG. 11 is a view similar to FIG. 10 in which the container consists of an inner liquid impervious container adapted to be fitted with the inlet/outlet stopper as described above and, in which the inner container is received within a disposable outer container and in which both the inner and outer containers may be readily inserted in a frame with the outer container having sufficient strength to withstand internal pressurization forces and to distribute the pressurization forces to the frame, and in which the outer container and the inner container are made of collapsible construction so that they may be shipped in knocked-down configuration from the container manufacturer to the filler of the container.

In regard to the cylindric drum of wrapped paper construction shown in FIGS. 10 and 11, the cylindric shape of the outer containers 5' and 5'' contribute significantly to the ability of container 3' or 3'' to withstand internal pressurization of inner container 7' or 7''. It will be appreciated that, in certain instances and with certain types of outer container construction, the wire mesh the cylindric shroud 11' shown in FIG. 10 may be omitted and the cylindric container 5' may be inserted directly in the open construction frames 15' or 15'' whereby the frame is of sufficient strength to withstand the pressurization forces of the container. Still further, it will be understood that the cylindric cross section outer container 5' may be constructed with a slight draft or taper thereby to permit the empty outer containers to be stacked or nested within one another for more compact shipment to the point of use or filling of the container.

Referring to FIG. 11, outer container 5'' is generally of cylindric shape. As indicated at 73, however, fold or score lines extending longitudinally of the outer container are provided therein whereby the cylindric outer container may be folded flat along fold lines 73 thereby permitting the outer container to be shipped prior to use in a knocked-down or folded position thereby to conserve space. This knock-down cylindric outer container includes bottom flaps 75*a*, 75*b* hingedly attached to opposite sides of the container, as indicated at 76*a*, 76*b*, respectively, which may be folded closed upon erecting the container to its cylindric shape. These bottom flaps 75*a*, 75*b* may, for example, be taped or otherwise secured to one another to constitute a closed end for container 5''. Upon use, container 5'' may be erected by forcing the fold lines 73 inwardly so that the outer container assumes substantially a cylindric shape thereby to receive the inner container 7''. Alternatively, container 5'' may be open at both ends (i.e., flaps 75*a*, 75*b* may be omitted) and an over fitting lid 71'' may be secured to each of its ends thereby to support the ends of inner container 7''.

Referring again to the embodiment shown in FIG. 2, it will be understood that the rectangular outer container 5 of corrugated fiberboard construction is particularly advantageous because the outer container may be shipped to the user of the container in a flat or knocked-down state thereby to substantially decrease the volume occupied by the empty containers 3. The inner container or bladder 9 may be either blow molded on site in a suitable blow molding machine, or may be shipped to the manufacturer in a compact, folded position. Upon use, the outer container 5 is erected and the inner container or bladder 7 is inserted therein. Suitable flaps on the outer container may be secured in place (e.g., stabled or adhesive bonded to one another) to suitably enclose the inner container.

In FIG. 12, still another embodiment of the pressure dispensing system of the present invention is shown to be indicated in its entirety by reference character 1A. This system includes a cylindric container 3A generally similar to inner container 7'' shown in FIG. 10. However, the pressure containment means 11A of this embodiment is shown to be constituted by outer container 5A which is so constructed as to be capable of withstanding substantial pressure forces exerted thereon upon the internal pressurization of container 3A which is received within containment means 11A. As shown, over fitting end caps 71A are provided at each end of containment means 11A and are secured-in-place relative to the containment means after container 3 has been inserted therein in such manner as to effectively transfer tension pressure loads from lids 71A to containment means 11A. Container 3A has a filler neck 9A extending endwise therefrom adapted to be received in a corresponding opening (not shown) in the end face of its respective lid 71A. A stopper 27A is provided for being sealingly secured within fitting 9A in a manner similar to that heretofore described. Because the above-described opening in lid 71A does not sealably engage fitting 9A, gas pressure may not build up within containment means 11A (unless enclosed within container 3A) and thus container 11A may be said to be of open construction. Additionally, openings 76 may be provided in the end faces of lids 71A to further insure gas pressure cannot build up within containment means 11A.

Figure 13:
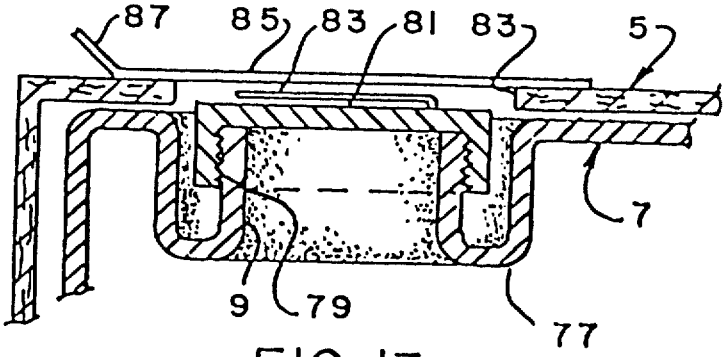
FIG. 13 is an enlarged cross-sectional view of a portion of the container generally as shown in FIG. 3 with the inlet/outlet opening of the container in a retracted position in which it is substantially retracted within the container so that the outer surfaces of the container are substantially flush, in which the opening is sealably closed by a suitable lid or cap, and in which a tear-away strip is provided for enabling access to the retracted, sealed opening, the opening nozzle being readily extendable from its retracted position shown in FIG. 13 to an extended position as shown in FIG. 3.

Referring now to FIG. 13, an enlarged view of a portion of the container 3 shown in FIG. 2 is illustrated including the portion of the container incorporating inlet/outlet fitting 9. As illustrated in FIG. 13, the filler neck 9 is integrally connected with inner container 7 by means of a rolling diaphragm-type neck 77. The filler neck may be provided with external threads 79 and a screw cap 81 may be threadably, sealingly screwed onto the filler neck thereby to close and to seal the contents within inner container 7. A finger hold 83 (shown in stowed position) may be provided on the upper surface of screw cap 81 thereby to permit the user to readily grasp the finger hold and to pull the filler neck 9 from its folded, stowed position (as shown in FIG. 13) to an extended position (as shown in FIG. 2) in which the neck extends outwardly through an opening 83 provided in outer container 5. A removable cover 85 overlies and covers opening 83 thereby to seal dust and dirt out of the inner container. Cover 85 is provided with a finger tab 87 permitting the user to readily grasp the cover and to tear it away from outer container 5 for uncovering the filler neck 9 and cap 81. In this manner, with the filler neck 9 in its retracted or stowed position, the containers 3 may be readily stacked on one another without interference or damage to their filler necks 9.

In operation, a user of the system or apparatus of this invention fills inner container 7, when installed in outer container 5, with a suitable liquid to be dispensed, and seals the inlet/outlet opening 9 by means, for example, of the screw cap 81, as shown in FIG. 13. The filler neck is then pushed inwardly to its retracted position and the cover strip 85 is applied over opening 83 in outer container 5 thereby to seal and enclose the filler neck. The filled semi-bulk containers 3 are then transported or shipped to the end user and, due to the compactness of the semi-bulk containers, they may be readily transported and stored until ready for use. The end user grasps the finger hold 87 of cover 85 and rips the cover free of opening 83 thereby exposing the cap 81 and manually grasps ring 81 and pulls the filler neck 9 to its extended position, as shown in FIG. 2. Container 3 is then inserted in (i.e., slid axially into) pressure containment shroud 13 so that filler neck 9 is received in slot 16 in the shroud. Then, container 3 together with the pressure shroud is then installed in frame 15. The upper frame members 21*a*, 21*b* are then swung from their open position (as shown in dotted lines in FIG. 2) to their closed position and locking bar 25 is inserted through the apertures provided in the end frame members and in the outer ends of members 21*a*, 21*b* thereby to lock the swingable frame members to the end frames and to securely hold the shroud within the frame. Then, screw cap 81 is removed from the filler neck and stopper assembly 27 is fitted within the inner bore of the filler neck 9 in the manner generally shown in FIG. 8. With the stopper so installed, dip tube 31 extends downwardly into the liquid contained within inner container 7 and is disposed slightly above the bottom wall of the container as shown in FIGS. 3 and 4. Then, flexible strap 63 is tightened around the outside of the filler neck by means of wing nut 65 thereby sealably securing stopper body 29 within the filler neck 9 so as to seal the stopper body relative to the filler neck. Dispensing line 47 is then connected to dip tube 33 and pressurization line 45 is connected to pressurization line 31 by means of quick-disconnect fittings 35. After the dispensing line 47 and the pressurization line 45 have been connected to their respective dip tubes and pressurization tubes, the valve on gas bottle 41 is opened and gas pressure regulated to a predetermined pressure level by gas pressure regulator 43 is admitted into the interior of inner bag 7 thereby to pressurize the inside of the bag and the liquid contained therewithin. This internal pressurization forces liquid out of the bag via dip tube 33 for discharge to a remote location via dispensing line 47. It will be understood that pressure relief valve 46 will prevent over-pressurization of the container 3, and, upon depressurization of the container, pressure from within the container may be relieved by means of the bleed valve (not shown) incorporated in the relief valve.

It will be understood that the construction of container 3 may be relatively inexpensive, due primarily to the fact that the container itself need not withstand the internal pressurization forces, thus permitting the empty container to be economically disposed.

Further in accordance with this invention, it will be appreciated that in certain applications, outer container 5 may be omitted and inner container 7 may be inserted directly in pressure containment means 11 (i.e., shroud 13) whereby the pressure forces within container 7 are transmitted directly to the pressure containment shroud.

In accordance with the method of this invention, a liquid or other flowable, liquid-like material may be dispensed from a semi-bulk, disposable container 3 by first filling the container with the liquid to be dispensed. Then, means, such as stopper assembly 27, is inserted into the inlet/outlet opening of the container for permitting pressurization of the liquid within the container and for permitting dispensing of the pressurized liquid from therewithin. The container is inserted with a containment vessel or structure 11 of generally open construction thereby to withstand and transfer the pressurization forces exerted on the container. Then the container within the containment vessel is pressurized to a predetermined pressure level by, for example, a pressurization source 39 via a pressurization line 45, thereby to pressurize the liquid inside the container. The pressurized liquid is dispensed from within the container via a dispensing line 47 connected to the opening (i.e., connected to dip tube 33).

Figure 14:
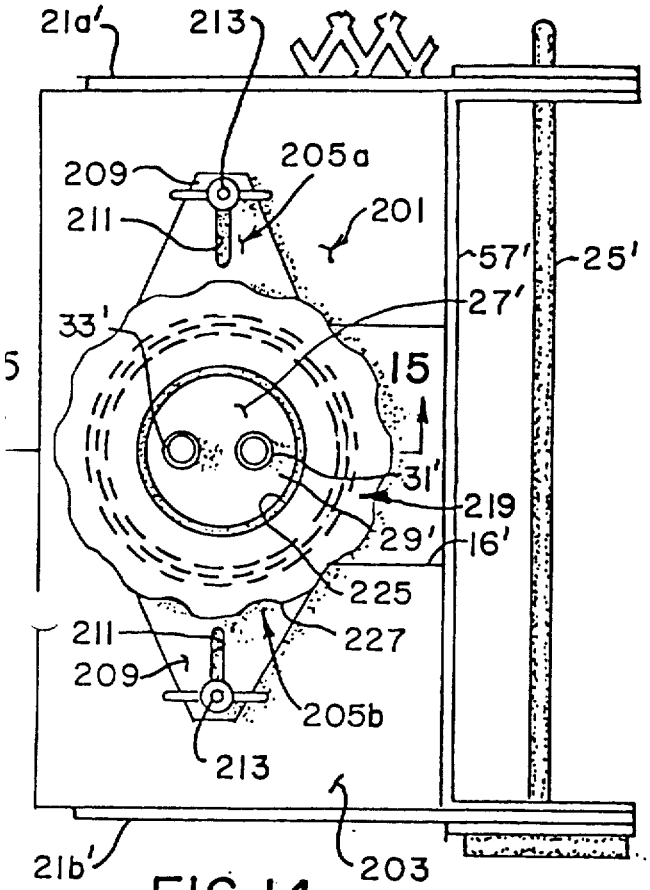
FIG. 14 is a view similar to FIG. 9 illustrating an alternative system for supporting the opening of the container when the latter is pressuized and for sealably securing the pressurization port/dip tube stopper in the container opening.
Figure 16:
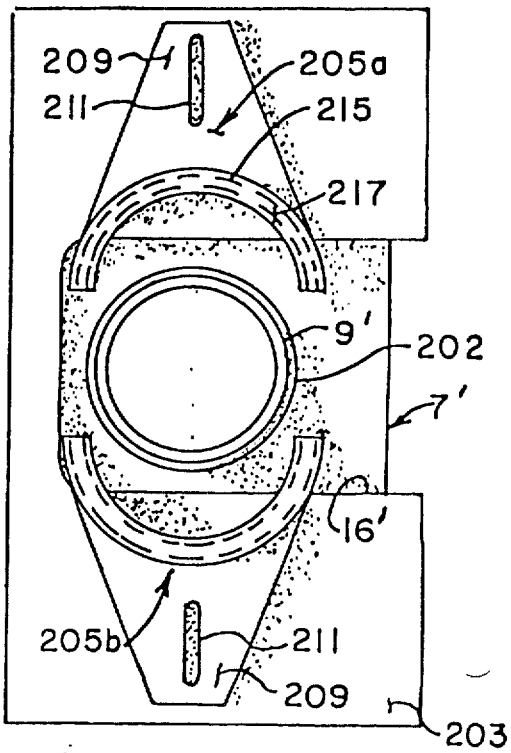
FIG. 16 is a view similar to FIG. 14 showing a support plate with a blind notch therein for reception of the container opening and showing the opening support members in their open position so as to enable a container opening to be inserted therein, the conainer opening, stopper, and support screw cap shown in FIGS. 14 and 15 being omitted for clarity.
Figure 15:
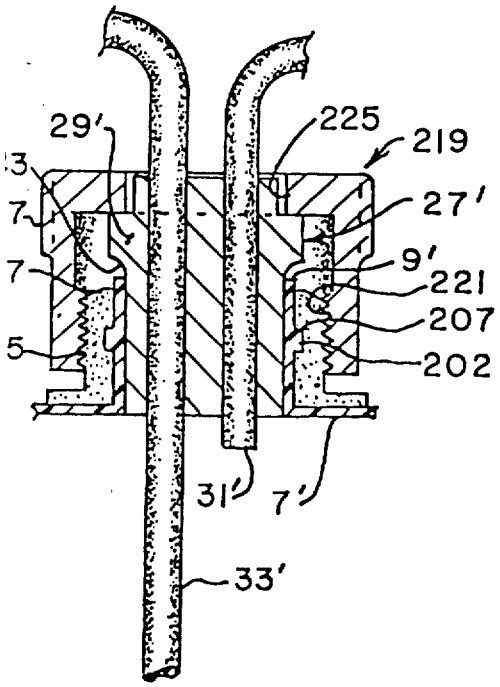
FIG. 15 is a cross-sectional view of the system illustrated in FIG. 14 taken along line 15—15 of FIG. 14.

Referring now to FIGS. 14–16, an alternative stopper securement means, as indicated generally at 201, is shown. This alternate stopper securement means is similar in certain respects to means 37 heretofore discribed. Corresponding parts having corresponding functions are indicated in FIGS. 14–16 by "primed" reference characters.

In FIGS. 14–16, container 7' has an inlet/outlet opening 9'. Container 7' may be a bag or a flexible container and opening 9' may be moved between a retracted position, such as shown in FIG. 13, and an extended position. Opening 9' includes and outwardly extending, circumferential flange 202 extending therearound. A reinforcing plate 203 is secured to containment vessel 13'. This plate has a blind notch 16' therein for reception of opening 9' as the container 3' is slid endwise into the containment vessel.

Plate 203 has a pair of opposed collar halves 205*a*, 205*b* slidably mounted thereon movable between an open position (as shown in FIG. 16) in which a container opening 9' may be received in notch 16' and a closed position in which the collar halves 205*a*, 205*b* each have a respective groove 207 on its inner face for receiving flange 202 on opening 9' as the collar halves move to their closed positions thereby to firmly support the opening 9' and to prevent it from moving in axial direction. Each collar half has a respective flange 209 thereon with a slot 211 therein. A stud 213 is secured to and extends from plate 203 for reception in the slot 211 thereby to restrain movement of the collar halves between their open and closed positions. Collar halves 205*a*, 205*b* each have external threads 215 and a upper end 217.

A screw cap 219 having internal threads 221 therein threadably engages threads 215 on collar halves 205*a*, 205*b* when the latter are in their closed position. A stopper 27' is fitted into the bore of opening 9' and carries a pressurizing tube 31' and a dip tube 33'. Stopper 27' has a stopper body 29' with the latter having a shoulder 223 engageable with the upper edge of opening 9' thereby to sealably compress the opening 9' between stopper body 29 and collars 205*a*, 205*b* thereby to positively seal the stopper with respect to container opening 9'. It will be also understood that since shoulder 223 is engageable with the upper edge of opening 9', this serves to accurately locate the lower end of dip tube 33' relative to the lower inside face of inner container 7' so that upon pressurizing the container, the end of the dip tube is located in close proximity to the inside surface of the inner container thereby to insure that substantially all of the liquid in the container can be dispensed via the dip tube. Preferably, the lower end of dip tube 33' is located within about 1/16 inch of the inside surface on the inner container. Of course, it will be understood that a depression or well 49' may be provided in the container wall opposite opening 9' for the lower end on dip tube 33'.

Cap 219 has a central aperature 225 through which stopper 27' may extend. Cap 219 further has a knurled outer surface 227 thereby to permit it to be manually tightened and loosened from collar halves 205*a*, 205*b* without using even simple hand tools.

It will be understood that since collar halves 205*a*, 205*b* are mounted on plate 203 which in turn is carried by containment vessel 13', and since stopper 27' is sealably secured to the container opening solely by the cooperation of the collar halves and cap 219, it would not be possible to sealably install stopper 27' in opening 9' unless container 3' were first installed in the pressure containment means 11'.

Figure 17:
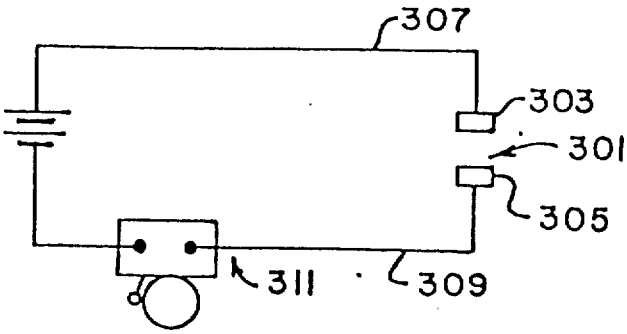
FIG. 17 is an electrical schematic of a sensor carried by the dip tube for generating a signal in response to the liquid level dropping below a predetermined level.

Referring now to FIGS. 4 and 17, means, as indicated generally at 301, is provided for generating a signal in response to the level of the liquid dropping below a predetermined level within container 7 thereby to alert personnel that the nearly empty container should be exchanged for a full container. This alarm means 301 is shown to comprise a first electrode 303 mounted on dip tube 33 at a desired location thereon and exposed to the liquid within container 7. A second electrode 305 is mounted in close proximity to electrode 305 and it too is exposed to the liquid. Preferably there is only a small vertical separation between electrodes 303 and 305 and the electrodes are located near the lower end of dip tube 33. Electrodes 303 and 305 are connected to a low voltage source of power, (e.g., a 9 volt battery) by respective wires 307 and 309. An alarm bell or other signal generating means 311 is connected in series to electrode 305 and the battery. This bell is normally de-energized when current is flowing therethrough, but, upon interruption of the current, is energized thereby to generate a signal and to sound an alarm. Bell 311 is energized upon the liquid level dropping below the level of electrode 303 thereby breaking the circuit between electrodes 303 and 305.

Referring now to FIGS. 18–23, still another embodiment of the system and apparatus of the present invention is illustrated. More specifically, this additional embodiment includes a containment means, as generally indicated at 401, in which a cylindric shroud 403 is adapted to be readily inserted therein and removed therefrom. The cylindric shroud 403 is open at its ends and is adapted to have a cylindric or multi-sided polygonal disposable container, similar to container 3A illustrated in FIG. 12, inserted within the shroud from one open end thereof. Then, the shroud, together with container 3A disposed therewithin, is fitted into containment means 401.

Specifically, containment means 401 includes an upper head assembly 405 and a lower head assembly 407. Each of these head assemblies includes a cup-shaped sheet metal member 409 having an integral flange 411 extending inwardly of the containment means. Further, each of the head assemblies includes an inside sheet metal plate 413. A plurality of tension carrying strap members 415 (as shown, three such strap members are provided) are rigidly secured (e.g., welded) to the head assemblies 405 and 407 (i.e., to flanges 411) thereby to positively maintain the inside face plates 413 in a desired space apart relation so as to permit the ready insertion of shroud 403 (with container 3A therein) into the containment means and withdrawal of the shroud and the container, and yet to securely hold the head assemblies in place upon internal pressurization of the container in a manner as will appear.

In accordance with this invention, each head assembly 405, 407 includes a shear carrying core member 417 secured within the head assembly between the inside outer face of cup member 409 and plate 413. This shear carrying core 417 may be of any suitable material having sufficient compressive strength to withstand the compressive force exerted on the head assemblies 405 and 407 upon internal pressurization of the disposable container and also having sufficient shear strength to withstand the shear stresses transmitted through the core material upon the head assemblies being subjected to bending forces upon pressurization. For example, this core material may be of a suitable honeycomb material of an aluminum alloy, of a waterproof paper, or of a phenolic material, such as commercially available from Hexcel of Dublin, Calif. Alternatively, the core material may be of a suitable synthetic resin material, such as an expanded polystyrene foam or the like, or the core material may be of a suitable wood, such as end grain white oak. Regardless of the core material selected, it is preferred that the core material 417 be firmly secured to the inner faces of cup member 409 and to the inside plate 413 in any suitable manner, such as by adhesive bonding with a suitable epoxy adhesive or the like. It will be appreciated that with the above-described composite structure of the head assemblies, a flat inside surface of the head assemblies can be maintained thereby to receive the flat ends of the disposable container 3A fitted within containment means 401, and yet the head assemblies will possess sufficient rigidity and strength to withstand high pressure loadings applied to the container substantially without deflection. Still further, such a lightweight construction technique allows the use of relatively light gauge metal (e.g., 20 gauge stainless steel alloy) for cup member 409 and inside plate 413 and yet possesses sufficient strength and rigidity to withstand internal pressure forces within disposable container 3A up to about 520 psig. In the above-stated example, it will be understood that the container 3A has an effective diameter of approximately 10 inches (25.4 cm.).

Containment means 401 further includes a removable door or closure assembly, as generally indicated at 419, which may be locked in place on the containment means after shroud 403 with disposable container 3A therewithin has been inserted within the containment means thereby to provide a structural connection on the open side of the containment means at the front thereof. This door 419 functions as a load carrying tension member much in the same manner as the secured-in-place straps 415. It will be appreciated that any one of a number of different door or closure designs for containment means 401 may be utilized, including the hinged door-type closure, as indicated at 21 in FIG. 2. However, in containment means 401, an alternative closure arrangement 419 is used which is readily removable from the containment means to permit installation and removal of shroud 403 and which may be readily locked in place on the containment means once the shroud together with the disposable container 3A has been inserted therein and once it is desired to pressurize the disposable container.

More specifically, door or closure 419 includes a sheet metal tension carrying strap 421 of sufficient length to span between the upper and lower surfaces of head assemblies 405 and 407. As shown in FIG. 18, a plurality (e.g., 4) of shear carrying pins 423 are rigidly affixed to and project outwardly from side flanges 411 of head assemblies 405 and 407. Strap 421 includes a plurality of apertures 425 adapted to receive shear pins 423 when the door assembly is installed on containment assembly 401 and is locked in position whereby upon pressurization of container 3A, tension loading between head assemblies 405 and 407 is efficiently transferred through strap 421 by the shear pins 423. Closure 419 further includes a plurality of fingers 427 which carry spring-loaded latch detents 429. These fingers 427 are received in brackets 431 which have openings 432 therein for receiving detents 429 as the closure assembly is fitted onto the containment means. As the closure assembly is moved to its fully installed position, the detents are cammingly depressed and they spring outwardly and are received by the detent openings 432 thereby to positively lock the closure assembly 419 in place on the container means.

Referring to FIG. 19, the top head assembly 405 includes a notch, as generally indicated at 435, in one face thereof adjacent closure 419. This notch is adapted to receive the inlet outlet opening 9A of container 3A and for further receiving on inlet/outlet stopper, as generally indicated at 437 (best shown in FIG. 21). As illustrated, slot 435 is constituted by a U-shaped channel member 439 which has an open outer end and which has a part-circular inner end. A spacer 441 is secured between the upper flange of channel 439 and the lower face of cup member 409, as by spot welding. Thus, the upper skin of cup member 409, spacer 441, and the upper flange of channel 431 constitute a support flange F for purposes as will appear.

Stopper 437 is shown to include a biody 443 of, for example, a suitable synthetic resin material. Body 443 has a circumferential groove or slot 445 threaround adapted to slidably receive support flange F when the stopper is slid in horizontal direction into slot 435 from the open end of the slot, as shown in FIG. 21. It will be appreciated with support flange F received in circumferential slot 445, stopper 437 is positively prevented from moving in axial direction with respect to head assembly 405. Further, because the inner end of slot 435 is part circular, stopper 437 is supported around approximately 180° of circumference by support flange F fitted within circumferential slot 445.

Stopper 437 has a counterbore 447 in its bottom end adapted to receive inlet/outlet 9A of container 3A. As shown best in FIG. 23 inlet/outlet 9A of the container has a closure 449 hermetically sealed in place thereon after filling of the container in any one of a number of well-known manners (e.g., being crimped in place by a metal clamping ring 450) thereby to sanitarily enclose the liquid contents within the container. In accordance with this invention, closure 449 includes puncturable diaphragm means as indicated at D, for sealing apertures 451 and 453 in closure 449.

Still further, stopper 437 includes a dip tube 455 carried by and sealably secured to body 443 in communication with a liquid dispensing passage 457. A suitable quick disconnect fitting 459 is carried by the stopper in communication with liquid dispensing passage 457. A gas inlet tube 461 projects downwardly a short distance from the base of counter bore 437 and is in communication with an air passage 463 within stopper 437. A quick disconnect fitting 465 is secured to the passage in communication with air passage 463 thereby to permit gas pressurization line 45 to be readily connected to and disconnected from stopper 437. It will be appreciated that dip tube 455 and gas pressurization tube 461 are spaced apart on stoppr 437 substantially the same distance that openings 451 and 453 are spaced on closure 449 of container 3A.

In operation, the container 3A is opened to expose inlet/outlet 9A (as explained in regard to FIG. 13) and the inlet/outlet is withdrawn from the container. With inlet/outlet 9A extended from the container (and preferably with the container inserted within shroud 403), a user of the system of this invention takes stopper assembly 437 and moves the lower end of dip tube 455 into register with either of the openings 451 or 453 on closure 449 and pushes downwardly thereby to puncture one of the diaphragms D. The user then fully inserts dip tube 455 into the container. It will be appreciated that because the dip tube is located off center with respect to inlet/outlet 9A of the container, the user may be required to rotate stopper 437 about the axis of dip tube 455 so that the neck 9A of the container will be received within counterbore 447, as shown in FIG. 21. Upon rotating the stopper relative to the container so that the inlet/outlet 9A fits within the counterbore, the shorter length gas tube 461 is thus automatically aligned with its respective opening 451 or 453 and this remaining diaphragm D is punctured by the gas tube.

Alternatively, openings 451 and 453 may be sealed by a removable adhesive tape (not shown) which is removed before dip tube 455 and gas tube 461 are aligned with and inserted into openings 451 and 453.

With stopper 437 installed in the container, as above-described, and with the container inserted in shroud 403, the user aligns circumferential slot 445 on stopper 437 with support flange F of the upper closure head 405 as the shroud with the container therein is slid into the containment means. With the shroud, the container, and the stopper so installed in the containment means 401, closure 419 is locked in place on the front of the closure means thereby the positively retain the shroud within the containment means.

It will be appreciated that suitable gas pressurization hose 45 and liquid dispensing line 47 may be connected to the respective quick disconnect fittings 459 and 465 so that upon application of pressurized gas to the inside of container 3A via the gas pressurization tube, internal pressure within container 3A will cause closure 9A to move upwardly within counterbore 447 of stopper 437. Further, the stopper includes seal means, for example an O ring **467*a* surrounding both the dip tube 455 and an O ring 467*b* surrounding the gas pressurization tube 461 at the base of counterbore 447, so that as gas pressure within container 3A drives closure 9A upwardly, a leak-tight seal is formed around both the dip tube and the air pressurization tube. Alternatively, the sealing O-rings 467***a*, 467*b* carried by stopper 437 could be replaced by compressible seals (shown in FIG. 23) integrally molded on the upper surface of closure 449. It will be understood that because closure apertures 451 and 453 remain sealed until the dip tube and the gas pressurization tube have pierced diaphragms D or until the sealing tape is removed, the contents of container 3A are maintained in a sanitary condition. Further, as diaphragms D are pierced by dip tube 455 and gas tube 461, the diaphragms exert a sliding, wiping, sealing force on the exterior of the dip tube and the gas pressurization tube thus permitting the container to be turned on its side without leakage of the liquid from within the container and permitting the interior of container 3A to be initially pressurized. Upon increase in internal gas pressure within the container, additional sealing force will be exerted against O rings 467*a*, 467*b* thus effecting a self-sealing of closure 449 the container inlet/outlet 9A relative to stopper assembly 437.

Further, the internal gas pressure within the container exerts an upward or outward force on stopper 437 which is retained by support flange F relative to head assembly 405. In accordance with this invention, detents 469 may be optionally provided on the bottom face of the upper flange of channel 439 with these detents being received in a respective detent groove 471 in the lower sidewall of groove 445 of stopper 437. With the detents 469 received in detent groove 471 and with internal pressure exerting even a relatively low outward force on stopper 437, a substantial locking force is exerted on the stopper thus preventing it from being removed from either container 3A or from the head assembly 405 of containment means 401 at any time while container 3A is internally pressurized.

As best shown in FIG. 22, closure 419 carries a finger 473 which projects inwardly into slot 435 and which supports the top portion of the disposable container 3A outboard of inlet outlet neck 9A between the sides of slot 435. Additionally, finger 473 has a flange 475 which is adapted to be received in the outwardly facing portion of circumferential groove 445 of stopper 437 whereby the stopper is thus supported on all sides either by flange F or by the support flange 475 carried by finger 473. It will be understood that finger 473 is of sufficient width so as to be engaged by the under surfaces of the upper flanges of channel 439 whereby the channels transmit any pressure forces exerted on the support finger by the internal pressure in the box directly to head assembly 405.

Still further in accordance with this invention, stopper 437 may include a normally open spring biased valve 477 in communication with air passage 463, as shown in FIGS. 26 and 27, via a vent port 478. This normally open valve includes a valve member 479 movable between a normally open position in which gas pressure from within container 3A and within gas pressure passage 463 is vented to the atmosphere and a closed position in which the vent port is sealably blocked thereby permitting internal pressurization of the container via the gas pressurization tube 461. Preferably, valve member 477 is engaged by finger 475 and is moved to its closed position as the closure 419 is locked in place on containment means 401. Thus, the normally open valve 477 constitutes means for preventing pressurization of the disposable container 3A unless the disposable container is installed within containment means 401 and further constitutes means for preventing pressurization of the container unless the closure assembly 419 is positively locked in place on the containment means 401.

It will be understood that suitable handles may be installed on the containment assembly 401, on shroud 403, and on closure 419 for readily handling the apparatus. Additionally, suitable feet 479 may be secured to the bottom head assembly 407 so as to support the containment means above the floor.

While the shape of head assemblies 405 and 407 are illustrated in FIG. 19 to be of octagonal shape, it will be understood that the shape of the head assemblies could be varied. For example, the head assemblies could be circular. However, by providing an octagonal shape, it will be recognized that with the closure 419 removed from the containment means, the cylindric shroud 403 may be readily inserted within the containment means without interference from the tension carrying straps at opposite sides of the containment means. Further, with the octagonal shaped head assemblies, a flat side exists opposite slot 435 so that the containment means may be laid down in a horizontal position resting on the flat side opposite slot 435 thereby permitting the shroud together with the disposable container inserted therein to be readily dropped downwardly into the open containment means and so that stopper assembly 437 may be received within slot 435 in the manner illustrated in FIG. 21.

Referring now to FIGS. 24 and 25, an alternative arrangement of stopper assembly 437 is indicated in its entirety by reference character 437'. It will be understood that the "primed" reference numbers used in conjunction with FIGS. 24 and 25 indicating parts having a similar construction and function to the parts heretofore described in this specification.

Specifically, the disposable container 3A' is shown to be received within shroud 403' (shown in phantom) which in turn is installed within containment 401'. Container 3A' includes an outer container 5A' and an inner, liquid impervious container 7A'. The latter includes an inlet/outlet fitting or neck, as indicated at 9A'.

Fitting 9A' is sealed by means of a closure plug 501 which is fitted into the opening of fitting 9A' and which is sealably secured thereto in any suitable manner (e.g., adhesively, heat sealed, or mechanically) thereby to sanitarily seal a liquid product within inner container 7A'. Plug 501 includes an gas inlet opening 503 and a liquid dispensing opening 505. As best shown in FIG. 25, gas inlet opening 503 is of square cross section and liquid outlet opening 505 is of circular cross-section for purposes as will appear. As shown in FIG. 24, gas inlet opening 503 is in communication with the interior of inner container 7A' and liquid dispensing opening 505 is in communication with a dip tube 507 which is secured to plug 501 and which extends downwardly within container 7A' so that the lower, open end of the dip tube is adjacent the bottom of inner container 7A'. As indicated at 508, dip tube 507 may have holes in the sides thereof at the lower end of the dip tube such that the liquid contents of the inner container may enter the dip tube at the bottom thereof under pressure for being dispensed.

Further, it will be understood that puncturable diaphragm means sealably closes openings 503 and 505 prior to the installation of stopper assembly 437 on container 3A'. More specifically, these diaphragm means are shown to be a diaphragm 509 overlying and sealing openings 503 and 505. This diaphragm means may be constituted by a seal which is sealed in place on the top face of plug 501. Preferably, however, the plug 501 is molded of a suitable synthetic resin material with openings 503 and 505 molded therein. Dip tube 507 may be either integrally molded with plug 501 or may be sealably secured to the plug in communication with liquid dispensing port 505. Since dip tube 507 is of inexpensive resin and is within container 3A', it is diposable with the container. Since plug 501 is preferably molded of suitable synthetic resin material, the diaphragm means sealing openings 503 and 505 may be integral thin wall diaphragms molded in place on the plug.

In certain applications, it will be understood that the container 3A' in containment 401 may be inverted from the position shown in FIG. 24 and tube 507 may be used to introduce the pressurizing gas into container 3A' and the liquid may be dispensed via aperture 503 thereby to insure that all of the liquid is dispensed from the container.

Stoppr assembly 437' is shown to be substantially similar to stopper assembly heretofore described and shown in FIG. 21. The primary difference between stopper assembly 437' and the previously described stopper assembly 437 is that stopper 437' does not carry the elongate dip tube 455 described in regard to FIG. 21. Instead, stopper assembly 437' has a relatively short length of tubing in communication with air passage port 463' which constitutes the gas pressurization port and which is indicated at 511 in FIG. 24. Further, stopper assembly 437' includes another short length of tubing, as indicated at 513, in communication with liquid dispensing passage 445'. As shown in FIG. 25, gas pressurization port 503 is of square cross section and liquid dispensing port 505 is of circular cross section. Likewise, gas pressurization tube 511 carried by stopper assembly 437' has a square outer cross section adapted to sealably fit within gas pressurization port 503 and the liquid dispensing tube 513 is of circular cross section adapted to sealably, slidably fit within the circular cross section of liquid dispensing port 505. Thus, with the cross sections of ports 503 and 505 being different and with the cross sections of tubes 511 and 513 matching their respective ports in plug 501, stopper assembly 437' may only be applied to fitting 9A' such that the gas pressurization tube 511 is received by its respective gas pressurization port 503 and such that the liquid dispensing tube 513 is in register with its respective gas dispensing port 505 which in turn is in communication with dip tube 507. This insures that upon installation of stopper assembly 437' that upon connection of the gas pressurization hoses and liquid dispensing hoses to fittings 459' and 465' that gas will properly enter the container and liquid will be properly dispensed from the container.

Further, as heretofore described in regard to stopper assembly 437, it will be understood that upon admitting gas pressure into container 3A, the internal pressurization forces wil exert an upwardly directed force on plug 501 which effects sealing of the plug with seal means carried either by the bottom face of stopper 437' or seal means integrally molded on the top face of plug 501 thereby to positively seal the plug relative to the stopper. Additionally, this upwardly directed pressure force is transferred to head assembly 405 of containment 401 by support flange F' and this prevents the withdrawal of the stopper assembly from slot 435 in the upper head assembly.

It will be appreciated that the primary advantage derived from having dip tube 507 carried by plug 501 which comes with each container 3A' and which is disposed with the container is that the elongate dip tube 455 shown in FIG. 21 is eliminated. As shown in FIG. 24, the gas pressurization tube and liquid dispensing tubes 511 and 513, respectively, carried by stopper assembly 437 are protected by the skirt which extends down below their bottom ends and thus upon changing containers 3A' the outer surface of the dip tube is not as likely to become dirty and to require cleaning. Because dip tube 507 may be integrally molded or secured to container closure 501 and because the dip tube 507 may be of suitable synthetic resin material, it is relatively inexpensive. It will also be appreciated that by incorporating dip tube 507 with each container 3A', that only a small amount of vertical clearance is required to install stopper 437'. It is anticipated that in certain applications, even when the shroud 403' with container 3A' is withdrawn sidewise out of containment 401 there may not be sufficient vertical space above fitting 9A' of the container to permit the stopper assembly 435 with elongate dip tube 455 carried thereby to be inserted downwardly into the container. Additionally, it will be appreciated that the quick disconnect fittings carried by stopper assembly 437' may be routed out the side of the stopper body so as to extend generally horizontally outwardly of slot 435' and thus the upper portion of stopper assembly 437' above the level of circumferential groove 445 may not be necessary. This would permit the stacking of one containment means 401 on top of the other and yet would permit the ready insertion of shroud 403 with container 3A therein into and out of its respective containment means.

Referring to FIG. 20, shroud 403 may be fitted with a secured in-place insert 601 in its bottom. This insert may be molded of a synthetic resin foam, such as a polystyrene foam, and has an inner female part-spherical surface 603 adapted to receive and to uniformly support the bottom of a disposable container having a part-spherical end thereby to efficiently transfer pressure forces from the end of the disposable container to the shroud 403 and to containment means 401 upon internal pressurization of the container. Further, a removable insert 605 may be inserted in the top of shroud 403 after the container has been fitted therein. This removable top insert has an inner surface 607 adapted to mate with the outer shape of the upper end of the disposable container and to efficiently transfer internal pressure loads to the shroud and the containment means. Of course, upper insert 605 may be provided with an opening (not shown) permitting inlet/outlet opening 9A of the disposable container to extend upwardly to receiver stopper 437, as heretofore described.

By providing shroud 403 with inserts 601 and 605, it will be understood that the apparatus and system of this invention may be used to accommodate disposable containers having part-spherical upper and lower ends, such as containers which are stretch-blow-molded of suitable resins such as polyethylene terephthalate (PET) which are capable of storing and transporting carbonated beverages such as pre-mixed soft drinks and draft beer.

Figure 29:
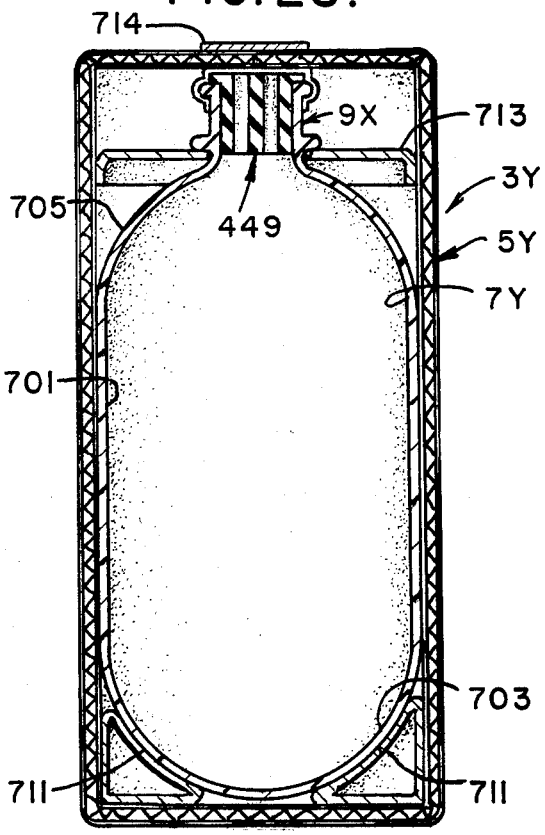
FIG. 29 is still another embodiment of a disposable container for use with this invention generally similar to the blowmolded bottle shown in FIG. 28 except that the base cup is omitted and that the bottle is inserted in an outer shipping carton.

Referring now to FIGS. 28–32, another embodiment of the apparatus of this invention is shown. In particular, this apparatus is particularly adapted to accommodate stretch-blowmolded disposable containers, such as generally indicated at 3X (FIG. 28) or 3Y (FIG. 29). As shown in FIG. 28, the container is generally indicated by reference character 7X which is shown to be a self standing bottle of suitable synthetic resin material, such as PET. The bottle is shown to have generally cylindrical sidewalls 701, a bottom part-spherical lower end 703, and a part-spherical upper end 705. In certain applications, the walls of container 7X may be very thin, for example about 0.005 inch (0.125 mm.). Containers 7X and 7Y are both provided with an inlet/outlet opening, as generally indicated at 9X. As will be appreciated, because of the part-spherical bottom end 703 of the container, it would not be possible for container 7X to be self standing in an upright position, such as shown in FIG. 28. Accordingly, a base cup, as generally indicated at 707, is secured to the outer surface of the part spherical bottom end 703 of the container. It will be noted that base cup 707 has a flat bottom surface thereby permitting container 7X to stand in an upright position. Preferably, base cup 707 is formed of a suitable synthetic resin material, preferably a homogeneous synthetic resin foam capable of transferring pressure forces from within container 7X outwardly to the pressure withstanding apparatus of this invention in a manner as will more clearly hereinafter appear.

Inlet/outlet opening 9X of containers 7X and 7Y has a support ring 709 therearound and is provided with a closure or stopper, as generally indicated at 449. For example, stopper 449 may be substantially identical in construction and in operation as the stopper 449 heretofore described in regard to FIGS. 21 and 23. It will be understood that corresponding reference characters in FIGS. 28–32 indicate parts having a similar construction and function as the parts disclosed in regard to FIGS. 21 and 23.

Referring to FIG. 29, the alternative embodiment of the container 7Y is shown to be inserted in an outer shipping container, as generally indicated at 5Y, thus supporting the belled inner container 7Y and protecting the inner container during shipping and transport. Outer container 5Y is preferably of corrugated paperboard construction and may be of rectangular cross-section thereby to permit the ready stacking of containers 3Y for storage and shipping. Optionally, outer container 3Y may include paperboard inserts 711 within the container to take up the space between the part-spherical bottom end of inner container 7Y and the lower dimensions of the rectangular box. Still further, an optional spacer 713 engageable with inlet/outlet opening 9X of container 7Y may be inserted in the outer shipping container so as to support the neck of the bottle. In use, it will be understood that outer container 5Y is opened by removing a tear tape 714 and by reaching in, manually grasping the bottle, and lifting it out of the box. Container 7Y may be provided with a convenient lifting handle (not shown) to aid in removing it from shipping carton 5Y.

Further in accordance with this invention, a pressure withstanding apparatus of open construction (i.e., one not capable of sealably holding pressure therewithin) is indicated in its entirety by reference character 11X. Specifically, this pressure containment apparatus includes a telescopic shroud assembly, as generally indicated at 13X, for receiving either container 7X or 7Y and for closely conforming to the outer dimensions of the disposable container so that upon internal pressurization of the disposable container, all pressure forces exerted on the container are effectively transferred to pressure withstanding apparatus 11X whereby the disposable container itself does not have to carry any substantial pressure loading.

Figure 31:
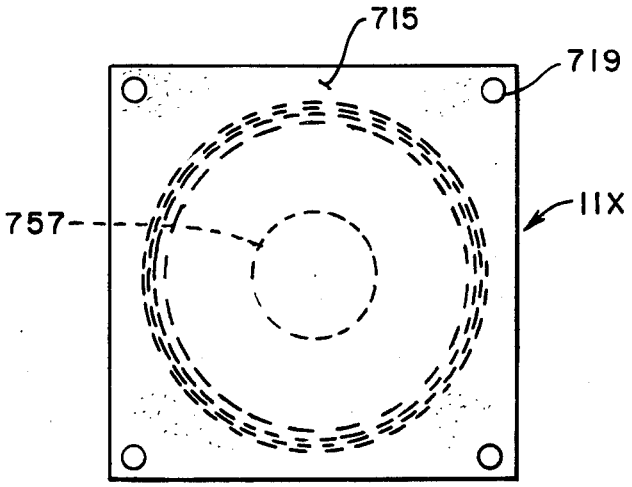
FIG. 31 is a top plan elevational view of FIG. 30.

Further, the pressure withstanding apparatus 11X includes a frame, as generally indicated at 15X, for receiving shroud 13X and for withstanding the axial loads exerted on the shroud upon internal pressurization of container 7X or 7Y. More specifically, frame 15X includes an upper head plate 715 and a lower head plate 717 rigidly interconnected and held in desired spaced apart relation by a plurality of tension rods 719. As best shown in FIG. 31, the upper and lower head plates are square and are of larger cross-sectional area than shroud 13X. Further, tension rods 419 are located at the outer corners of the square head plates 715, 717 and the rods 719 are spaced apart from one another a distance greater than the diameter of shroud 13X so that the shroud may be inserted into framework 15X between the tension rods from any side of the frame.

Figure 32:
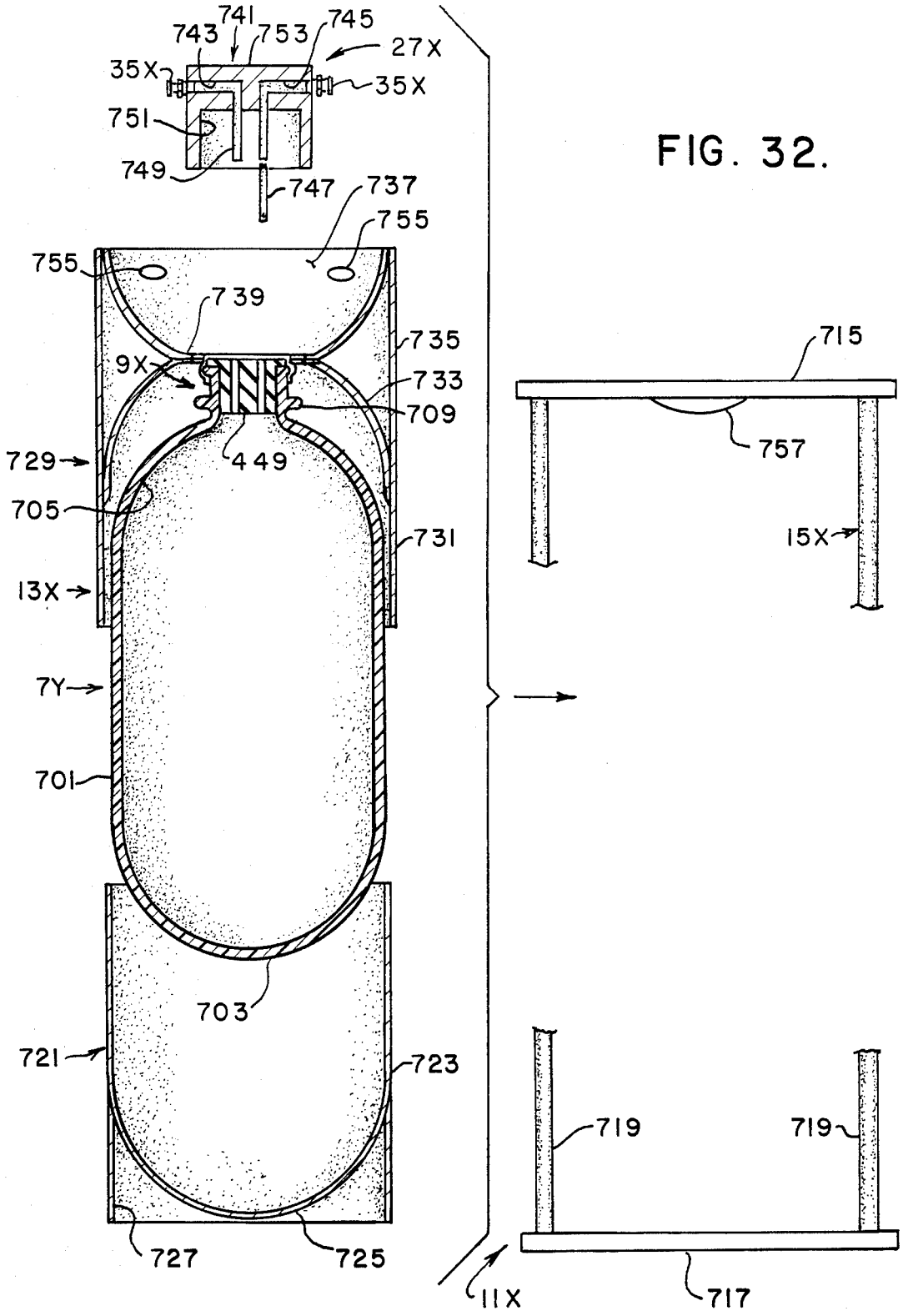
FIG. 32 is an exploded cross-sectional view of the shroud of the pressure containment apparatus and a container, such as shown in FIGS. 28 and 29, it being understood that the shroud and container shown in exploded view telescopically fit together and are inserted sideways into a pressure resisting frame.

In FIG. 32, shroud 13X is more clearly shown to be a telescopic shroud having a lower portion, as generally indicated at 721, comprising a cylindric portion 723 with an open upper end and having a part-spherical, female bottom 725 therewithin of generally the same interior dimension and shape as the outer surface of part spherical end 703 of container 7Y. A skirt 727 extends downwardly from cylindrical sidewall 723 below the level of part-spherical end 725. As will be understood by those skilled in the art, an alternative version of the lower portion 721 of shroud 13X may be provided in which part spherical dome 725 is omitted thereby being adapted to readily receive the lower end of container 7X having base cup 707 secured thereto wherein the base cup fits within cylindric shroud 723 and, upon internal pressurization of container 7X, the pressure forces exerted on the bottom end 703 of the container 7X are effectively transmitted outwardly via base cup 707 to the sidewalls of skirt 727 and to the inner face of bottom base plate 717.

Figure 30:
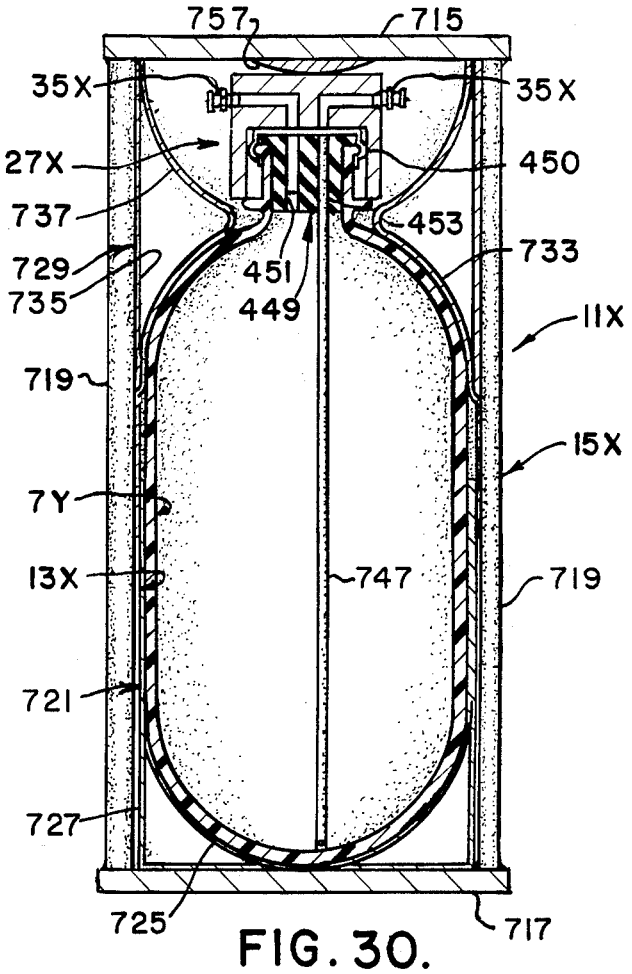
FIG. 30 is a view of still another embodiment of apparatus of this invention in which the disposable containers of FIGS. 28 and 29 (shown in cross section) are installed in pressure containment apparatus permitting the internal pressurization of the container and the dispensing of liquid therefrom and further permitting the pressure forces exerted on the disposable container during internal pressurization to be withstood by a pressure containment apparatus.

Further, shroud 13X includes an upper portion, as generally indicated at 729, comprising a lower, open-ended cylindrical portion 731 having an upper part spherical dome 733 integral therewith with the inner spherical surface of dome 733 being adapted to conform to the outer surface of the upper part-spherical end 705 of container 7Y. A skirt 735 extends up above the level of dome 733 and an inverted dome 737 is secured (e.g., welded) to the upper end of skirt 735 and extends downwardly into the skirt and joins the upper end of dome 733. An opening, as indicated at 739, is provided in domes 733 and 737 with the diameter of opening 739 being somewhat larger than the diameter of support ring 709 of container 7X or 7Y. Further, it will be understood that the diameter of cylindric portion 731 of the upper shroud portion 729 is somewhat greater than the diameter of cylindric portion 723 of the lower shroud portion so that the cylindric portions will telescopically fit together, as shown in FIG. 30.

In use, container 7X or 7Y is inserted in its respective lower shroud assembly 721 and it will be understood that the upper portion of the container extends up above the level of the cylindric section 723. Then, the upper shroud portion 729 is lowered down over the top of container, generally in the manner shown in FIG. 32, and inlet/outlet opening 9X passes through opening 739 in domes 733 and 737. At this point in time, preferably, the container 7X or 7Y remains in a hermetically closed, sanitary condition.

Further in accordance with this invention, a stopper assembly, as generally indicated at 27X, is fitted to inlet/outlet opening 9X of container 7X or 7Y in a manner generally similar to that described in regard to the various embodiments of this invention, as disclosed in FIGS. 18–27. More specifically, stopper assembly 27X includes a stopper body 741 of suitable synthetic resin material or the like having a gas inlet passage 743 and a liquid dispensing passage 745 formed therewithin. Each of these passages is fitted with a suitable quick disconnect fitting, as indicated at 35X, permitting the ready connection of gas supply hoses and liquid dispensing hoses in the manner heretofore described in regard to other embodiments of the apparatus of this invention. As indicated at 747, an elongate diptube is secured to stopper body 741 and is of sufficient length so that when the stopper is fitted to the inlet/outlet opening in the manner shown in FIG. 30, dip tube 747 will extend down to the bottom of the container. Further, a gas pressurization tube 749 is secured to stopper 741 in communication with gas inlet passage 743. A counterbore, as indicated at 751, is provided in the bottom end of stopper body 741 for receiving inlet/outlet opening 9X of container 7X or 7Y. It will be recognized that in many aspects stopper 741 is essentially identical in construction and in operation to stopper 437 described in regard to FIG. 21. However, stopper 741 has a flat upper surface for reasons as will appear. Further, the upper, reversed dome 737 may be provided with apertures 755 therethrough (and mating apertures through skirt 735) thereby permitting appropriate gas pressurization and liquid dispensing hoses to pass through the shroud assembly and to connect to fittings 35X on stopper assembly 27X.

In use, with container 7X or 7Y inserted in the lower shroud assembly 721, the upper shroud assembly 729 is fitted down over the upper end of the container until the inner surfaces of the upper dome 733 rest on the upper part-spherical shoulder 705 of the container. It will be understood with the shroud portions 721 and 729 so fitted on the container, the lower end of cylindric portion 731 of the upper shroud portion will be telescopically received on the outside of the upper end of cylindrical portion 723 of the lower shroud portion 721. Further, inlet/outlet opening 9X of the container will extend up through opening 739 of domes 733 and 737. With the container so installed in shroud 13X, dip tube 747 of stopper assembly 741 is aligned with one of the apertures 451, 453 in closure 449 sealably closing inlet/outlet opening 9X and the diaphragm D closing this aperture is pierced by the dip tube and the dip tube is inserted into the interior of container. Then, stopper assembly 741 is rotated about the axis of dip tube 747 so that gas pressurization tube 749 may be aligned with the other aperture 451 or 453 in stopper 449. Stopper assembly 741 is then pushed downwardly somewhat further so that the upper end of inlet/outlet opening 9X is received within counterbore 751 and so that the gas pressurization tube pierces the diaphragm D of its respective aperture 451 or 453. However, it will be understood rather than having the puncturable diaphragms D for aperture 451, 453, a removable tape seal or the like (not shown) may be provided, or a screw cap (also not shown) may be removed to uncover apertures 451, 453. With the appropriate gas pressurization hoses and liquid dispensing hoses sealably coupled to fittings 35X, the telescopic shroud assembly 13X is slid sideways into frame 15X from any side thereof between tension rods 719.

As indicated at 757 in FIG. 32 (shown in enlarged scale) a detent dome is provided on the inner face of the upper head plate 715 at the center thereof. It will be understood that with the container 7X or 7Y and telescopic shroud assembly 13X assembled as above described, that the overall length of the shroud assembly 13 from the upper end of skirt 735 to the lower end of skirt 727 is somewhat less than the distance from the bottom face of detent 757 to the inner face of bottom plate 717 thereby to permit the shroud to be readily slid sideways into frame 15X without interference from detent 757. Upon initial internal pressurization of container 7X or 7Y, the sliding, sealing fit between dip tube 747 and its respective aperture 451 or 453 in stopper 449 and the sliding, sealing fit between gas pressurization tube 749 and its respective aperture will provide sufficient sealing to permit low pressure internal pressurization of the container. This low pressure internal pressure will cause the shroud portions 721 and 729 to move axially relative to one another so that the upper and lower ends of their respective skirts engage the inner faces of upper plate 715 and lower plate 717. Further, the tendency of container 7X or 7Y to increase in axial length upon internal pressurization forces inlet/outlet opening 9X upwardly into counterbore 751 of stopper 741 and compresses the sealing gaskets 467A, 467B carried by the stopper (in the same manner as shown in FIG. 21) thereby to positively seal stopper 27X relative to container 7X or 7Y. Upon further internal pressurization of the disposable container, the telescopic shroud portions 721 and 729 are prevented from moving axially apart from one another by frame 15X and the shroud 13X withstands the pressure forces exerted on the container by the internal pressurization thereof.

In accordance with this invention, it will be understood that the provision of detent 757 is a desirable feature because in the event shroud 13X is not fully inserted into frame 15X, an increase in internal pressure within container 7X or 7Y will at a relatively low pressure cause stopper 741 to move upwardly away from closure 449 breaking the seal of O-rings 467*a*, 467*b*, thus effectively preventing pressurization of container 7X or 7Y to a relatively high level unless the shroud with the container is properly centered within frame 15X. Further, it will be understood that because stopper 27X is in no way mechanically secured directly to inlet/outlet opening 9X of container 7Y or 7X, it would not be possible to internally pressurize the container unless the container is properly installed in shroud 13X and unless the shroud is properly installed within frame 15X. Further, upon pressurization of container 7X or 7Y even to relatively low internal pressure levels, the axial force exerted on the telescopic shroud portions 721 and 729 exert sufficient force on the inner faces of upper and lower plates 715 and 717 so as to effectively prevent one from removing the shroud from frame 15X so long as the disposable container carries internal pressure therewithin.

By utilizing the construction of the containment system heretofore described, it will be understood that container 7Y or 7X may be blowmolded of relatively thin wall material, such that the containers themselves may not be self supporting when filled with liquid and when the containers are open to the atmosphere. It will be noted that the container 7X or 7Y may remain sealed until the puncturable diaphragm D for apertures 451, 453 are punctured by dip tube 747 and by gas pressurization tube 749. Alternatively, even if a removable seal is provided for apertures 451 and 453, container 7X or 7Y is fully supported within the shroud 13X before the removable seals for these apertures are removed. Thus, there effectively would be no leakage or spillage of liquid from the container.

In view of the above, it will be seen that the several objects and features of this invention are achieved and other advantageous results obtained.

As various changes could be made in the above constructions and methods without departing from the scope of the invention, it is intended that all matter contained in the above description or shown in the accompanying drawings shall be interpreted as illustrative and not in a limiting sense.

We claim:

1. Apparatus for dispensing a liquid from a disposable container, said disposable container having an inlet/outlet opening, and a closure sealably secured to said inlet/outlet opening, said apparatus comprising a shroud for receiving said disposable container and a frame for receiving said shroud, said shroud and said frame withstanding pressurization forces exerted on said container upon internal pressurization thereof, said shroud having a first and a second portion telescopically interfitting with one another, and a stopper assembly fitted to said inlet/outlet of said disposable container and being held in place relative to said disposable container by said shroud, said stopper assembly having means for internally pressurizing said container, means for discharging liquid from said disposable container under pressure, and means for sealing said stopper assembly relative to said disposable container upon internal pressurization of said disposable container.

2. Apparatus as set forth in claim 1 wherein said frame has a first end disposed proximate one end of the disposable container when the latter within said shroud is installed within said frame and a second end disposed proximate the other end of said disposable container, means secured to and spanning between said ends for transferring pressure forces between said ends upon pressurization of said disposable container, said shroud with said disposable container therein being disposed between said ends for withstanding pressure forces exerting on said disposable container.

3. Apparatus as set forth in claim 2 wherein said pressure withstanding means has means removably securable to said first and second ends which when removed enables said shroud with said disposable container therein to be installed in or removed from between said ends, and which when secured to said ends is capable of transferring loads therebetween.

4. Apparatus as set forth in claim 3 wherein said stopper assembly includes a normally open valve in communication with said gas pressurization tube, said valve being engageable by said means removably installable to said first and second ends so as to close said valve upon installation of the last-said means thereby only to permit internal pressurization of said disposable container when this last-said means is installed on said ends and when said disposable container with said stopper assembly is installed within said pressure withstanding means.

5. Apparatus as set forth in claim 2 wherein said first end of said frame includes means engagable with said stopper assembly upon the shroud with the disposable container received therein being received between said ends for holding said stopper assembly against axial movement relative to said first end and for preventing removal of said stopper assembly upon internal pressurization of said disposable container.

6. Apparatus as set forth in claim 2 wherein each of said ends is constructed of a composite assembly comprising an outer sheet metal face, an inner sheet metal face, and a core of shear carrying material secured therebetween.

7. Apparatus as set forth in claim 6 wherein at least one of said sheet metal faces has a flange integral therewith and extending generally axially with respect to said pressure withstanding means, said means spanning between said ends being secured to said flange.

8. Apparatus as set forth in claim 2 wherein one of said ends has a blind notch therein and further has a flange defining said notch, said stopper assembly having a groove therein adapted to receive said flange as said shroud with said disposable container installed therein and with the said stopper assembly fitted to said inlet/outlet opening is inserted between said ends thereby to positively prevent axial movement of said stopper assembly relative to said one end.

9. Apparatus as set forth in claim 2 wherein said shroud is adapted to mate with said disposable container and to transfer axial pressure forces from within said container to said frame.

10. Apparatus as set forth in claim 1 wherein said closure for said disposable container includes a first puncturable area, and wherein said stopper assembly includes a first tube puncturably insertable through said first puncturable area.

11. Apparatus as set forth in claim 10 wherein said stopper assembly further includes a second tube, and wherein said closure further includes a second puncturable area puncturable by said second tube thereby to permit internal pressurization of said container and to permit pressurized dispensing of the liquid from within said disposable container in said tubes.

12. Apparatus as set forth in claim 1 wherein said means for sealing said stopper relative to said disposable container comprises seal means interposed between said stopper assembly and said closure which, upon internal pressurization of said disposable container, seals said stopper assembly to closure.

13. Apparatus as set forth in claim 1 wherein, upon internal pressurization of said disposable container, pressure forces exerted axially on said frame by said stopper assembly positively prevents relative outward movement of said stopper assembly relative to said frame.

14. Apparatus as set forth in claim 13 wherein said apparatus further having detent means between said stopper assembly and said frame for positively preventing the removal of said stopper assembly upon internal pressurization of said disposable container.

15. In a container having an inlet/outlet opening, said container being adapted for pressure dispensing of a liquid from therewithin, and in a containment means for receiving said container and for supporting said container when internally pressurized, wherein the improvement comprises: a closure sealably secured to said inlet/outlet opening, said containment means including a shroud for receiving said container and a frame for receiving said shroud, said containment means further including a stopper assembly cooperable with said closure including a liquid dispensing and gas pressurization means, said liquid dispensing and gas pressurization means being puncturably insertable through said closure so that with said stopper assembly positively held against axial movement relative to said container by said containment means and upon internal pressurization of said container, internal pressurization forces within said container seal said closure relative to said stopper assembly and permit the pressurized discharge of liquid from within said container via said liquid dispensing and gas pressurization means.

16. In a container and containment means as set forth in claim 15 wherein said shroud includes means for supporting said container against internal pressurization forces proximate said inlet/outlet opening, this last-said means being clear of said inlet/outlet opening so that upon internal pressurization of said container, said inlet/outlet opening transmits axial force against said closure thereby, at least in part, to seal said closure relative to said inlet/outlet opening.

17. Method of dispensing a liquid from a disposable container of liquid impervious construction and having an inlet/outlet opening, said disposable container being adapted to be inserted in means for withstanding pressurization forces exerted on the disposable container upon internal pressurization thereof, said pressure withstanding means comprising a telescoping shroud receiving said container and a frame means for receiving said shroud with said container therein, said method comprising the steps of:

inserting said disposable container in said shroud;

fitting a stopper assembly to said inlet/outlet opening, said stopper assembly having means for dispensing liquid under pressure from within said container and means for internally pressurizing said container;

inserting said shroud with said container therein into said frame means;

restraining said stopper assembly against axial movement relative to said disposable container; and internally pressurizing said disposable container via said gas pressurization means thereby to effect self-sealing of said inlet/outlet closure relative to said stopper and to effect the dispensing of liquid from within said disposable container via said liquid dispensing means.

18. The method of claim 17 wherein said inlet/outlet opening of said disposable container is sealed by a closure, and wherein said method further comprises puncturing said closure as said stopper assembly is fitted to said disposable container thereby to place said pressurizing means and said liquid dispensing means in communication with the interior of said container.

19. A system for dispensing of a liquid from a disposable container containing a supply of liquid therein, said disposable container having at least one opening, said system comprising means sealably engageable with said at least one opening for permitting pressurization of said liquid within the container and for pressure dispensing of said liquid from within the container, and pressure containment means for receiving and for withstanding pressure forces exerted on said disposable container during internal pressurization thereof, said pressure containment means comprising a shroud having a first portion thereof adapted to receive at least one portion of said disposable container and having another portion thereof adapted to receive the other portion of said disposable container so that upon internal pressurization of said disposable container, said shroud supports said disposable container against the internal pressurization forces exerted thereon, said pressure containment means further comprising a frame adapted to receive said shroud for preventing substantial axial movement of the shroud portions relative to one another upon internal pressurization of the disposable container.

20. A system as set forth in claim 19 wherein said means sealably engageable with said opening comprises a stopper fitted to said at least one opening thereby to permit pressurization of said liquid and to permit pressure dispensing of said liquid from said container.

21. A system as set forth in claim 20 further comprising a liquid dispensing tube carried by said means sealably engageable with said opening and extending into said container in communication with the liquid therein so as to permit the liquid under pressure to be forced out of the container via said liquid dispensing tube.

22. A system as set forth in claim 20 wherein said stopper includes a gas pressurization tube and a liquid dispensing tube, each of which said tubes being insertable through said means sealably secured within said at least one opening for permitting pressurization of the liquid and for pressure dispensing of the liquid from within the container.

23. A system as set forth in claim 20 wherein with said shroud inserted within said frame and with said stopper fitted on said at least one opening of said container, said frame restrains movement between said stopper and said at least one opening of said container wherein, upon internal pressurization of said container, said stopper is prevented from moving away from said container and said at least one opening of the container is positively sealed relative to said stopper.

24. A system as set forth in claim 23 further comprising means between said at least one opening of said container and said stopper for sealing said container relative to said stopper upon internal pressurization of said container.

25. A system as set forth in claim 19 wherein one of said portions of said shroud is telescopically received within the other of said shroud portions so that upon internal pressurization of said container, said shroud portions move axially relative to one another such that opposite ends of said shroud portions are restrained against further axial movement by said frame.

26. A system as set forth in claim 25 wherein said means sealably engageable with said at least one opening is deposed between said at least one opening of said container and said frame so that upon internal pressurization of said container, said at least one opening is restrained against further axial movement by said means sealably engageable with said at least one opening.

27. A system as set forth in claim 19 wherein said frame includes means engageable with said means sealably engageable with said at least one opening only when said shroud is substantially fully inserted within said frame thereby to prevent pressurization of said container except when said shroud with said container received therein is inserted within said frame.

* * * * *

UNITED STATES PATENT AND TRADEMARK OFFICE

CERTIFICATE OF CORRECTION

PATENT NO. : 4,491,247

DATED : January 1, 1985

INVENTOR(S) : Harold L. Nitchman and William B. Cunningham, Jr.

It is certified that error appears in the above—identified patent and that said Letters Patent is hereby corrected as shown below:

Insert drawing FIGS. 1-17, as per attached sheets.

Signed and Sealed this

*Sixth* Day of *August 1985*

[SEAL]

*Attest:*

DONALD J. QUIGG

*Attesting Officer* *Acting Commissioner of Patents and Trademarks*

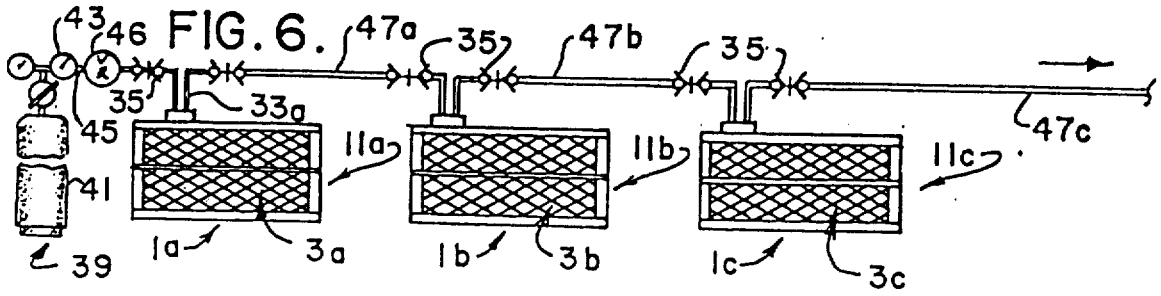
FIG. 6.
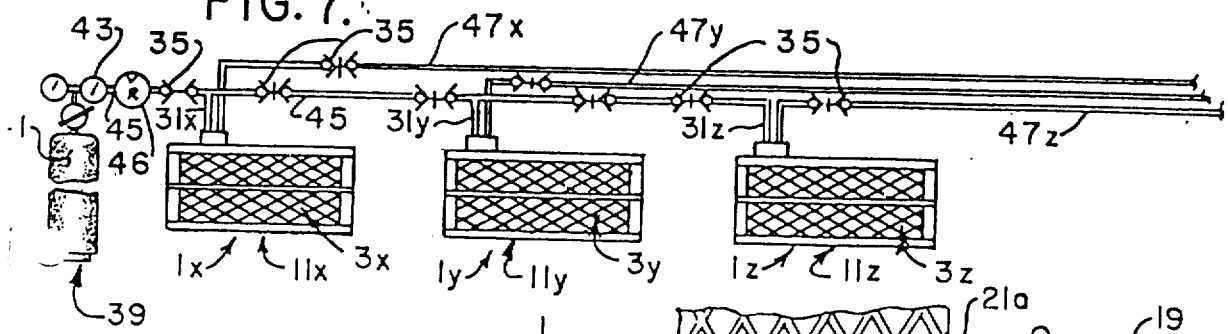
FIG. 7.
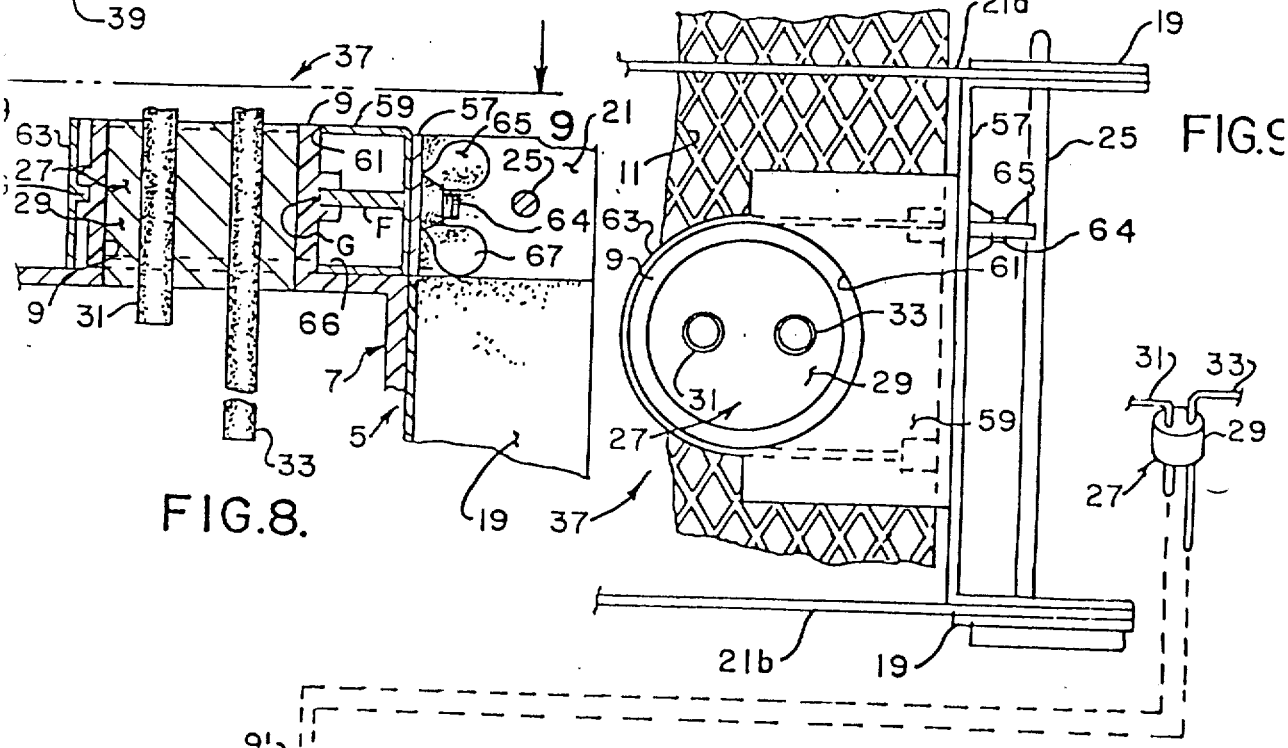
FIG.8.
FIG.9
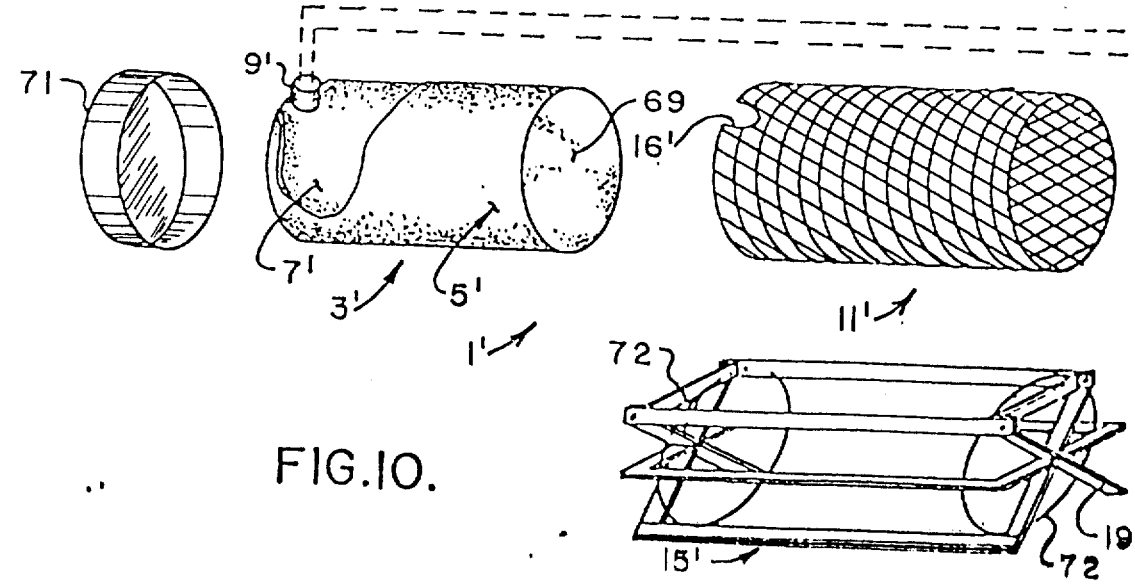
FIG.10.